US008070157B2

(12) United States Patent
Koyanagi

(10) Patent No.: US 8,070,157 B2
(45) Date of Patent: Dec. 6, 2011

(54) RECORDING APPARATUS

(75) Inventor: Noriyuki Koyanagi, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/844,159

(22) Filed: Jul. 27, 2010

(65) Prior Publication Data

US 2011/0024977 A1 Feb. 3, 2011

(30) Foreign Application Priority Data

Jul. 31, 2009 (JP) ..... 2009-179612

(51) Int. Cl.
*B65H 9/12* (2006.01)

(52) U.S. Cl. ..... 271/241; 271/171; 271/220

(58) Field of Classification Search ..... 271/241, 271/171, 220, 221, 223
See application file for complete search history.

(56) References Cited

U.S. PATENT DOCUMENTS

| | | | | |
|---|---|---|---|---|
| 4,908,673 | A * | 3/1990 | Muramatsu | 399/402 |
| 5,168,317 | A * | 12/1992 | Takano | 399/125 |
| 2006/0255531 | A1* | 11/2006 | Azzopardi et al. | 271/171 |
| 2009/0121412 | A1 | 5/2009 | Koyanagi | |

FOREIGN PATENT DOCUMENTS

| | | |
|---|---|---|
| JP | 2002-118757 | 4/2002 |
| JP | 2002-128286 | 5/2002 |
| JP | 2009-137762 | 6/2009 |

* cited by examiner

*Primary Examiner* — David H Bollinger
(74) *Attorney, Agent, or Firm* — Workman Nydegger

(57) ABSTRACT

A recording apparatus includes: edge guides which move in a width direction of the recording target medium and align side edges of the recording target medium which is stacked; a motor which moves the edge guides; a determining section which determines whether an electric current value when the motor is driven reaches a predetermined threshold value; and a position detecting section which detects a position of the edge guides in the width direction. Here, when the side edges of the recording target medium are aligned, the edge guides move close to the recording target medium and it is determined whether a difference between a position of the edge guides at the time when the electric current value reaches the predetermined threshold value and a position of the edge guides corresponding to the size of the recording target medium is equal to or smaller than a predetermined allowable value.

4 Claims, 14 Drawing Sheets

RECORDING APPARATUS

BACKGROUND

1. Technical Field

The present invention relates to a recording apparatus which includes a stacking section on which a recording target medium is stacked and edge guides which move in a width direction of the recording target medium and align side edges of the recording target medium stacked on the stacking section.

In this description, the recording apparatus includes an ink jet printer, a wire dot printer, a laser printer, a line printer, a copier, a facsimile or the like.

2. Related Art

As disclosed in JP-A-2002-128286, a recording apparatus in the related art includes feeding rollers which feed a recording paper which is an example of a recording target medium, and a hopper which can move close to or away from the feeding rollers and is a stacking section on which the recording paper is stacked. A pair of edge guides for guiding the recording paper in a width direction is installed in the hopper to be able to slide in the width direction. Accordingly, when a user sets the recording paper, the user firstly widens the edge guides in the width direction, and then stacks the recording paper on the hopper. Then, the user slides the edge guides in a narrowing direction to align opposite side edges of the recording paper. As a result, the recording paper can be fed in a stable posture.

However, the user should slide the edge guides to a predetermined position in a manual manner. Thus, in a case where the user does not perform the manual manipulation, it is likely that the posture of the recording paper which is being fed becomes inclined. Further, it is likely that the opposite side edges of the plurality of recording papers which is stacked on the hopper are not aligned. In these cases, variation may be generated in the position of the recording paper in the width direction, and thus, variation may be generated in a recording position with respect to the recording paper. As a result, desired recording may not be obtained.

SUMMARY

An advantage of some aspects of the invention is that it provides a recording apparatus which is capable of firmly aligning opposite side edges of a recording target medium to stabilize the posture of the recording target medium.

According to a first embodiment of the invention, there is provided a recording apparatus including: a stacking section on which a recording target medium is stacked; edge guides which move in a width direction of the recording target medium and align side edges of the recording target medium which is stacked on the stacking section; a motor which moves the edge guide; a determining section which determines whether an electric current value at the time when the motor is driven reaches a predetermined threshold value; and a position detecting section which detects a position of the edge guides in the width direction, wherein when the side edges of the recording target medium are aligned, the edge guides move close to the recording target medium by means of power of the motor while the electric current value is being monitored by the determining section, and it is determined whether a difference between a position of the edge guides at the time when the electric current value reaches the predetermined threshold value and a position of the edge guides corresponding to the size of the recording target medium which is recognized on the basis of recording information by the recording apparatus is equal to or smaller than a predetermined allowable value, and wherein if it is determined that the difference is not equal to or smaller than the predetermined allowable value, the edge guides move away from the recording target medium by means of the power of the motor, and then, the edge guides move close to the recording target medium until the electric current value reaches the predetermined threshold value while the electric current value is being monitored.

In this respect, the "predetermined threshold value" is larger than an electric current value at the time when the edge guides press the recording target medium of which the side edges are not aligned in the aligning direction during the movement of the edge guides, and is smaller than an electric current value at the time when the edge guides are in contact with the side edges of the recording target medium of which the side edges have been aligned.

The "recording information" refers to data information converted for performance of recording in the recording apparatus.

The "predetermined allowable value" refers to a value which can be allowed in consideration of errors, which is used for determining whether the difference is in a specific width range in which errors are considered.

The "motor" is preferably a DC motor since the DC motor can easily detect a change in the electric current value. In this respect, the DC motor uses direct current power, and includes a so-called brush DC motor or brushless motor but does not include a stepping motor which is driven in proportion to the number of input pulses.

According to the first embodiment, in the case where it is determined that the difference is not equal to or smaller than the predetermined allowable value, the recording apparatus may determine that the side edges of the recording target medium on the stacking section are in a non-aligned state. Thus, the edge guides may strike the side edges of the recording target medium once again, so as to align the side edges of the recording target medium in a tidier manner. This process is repeated until it is determined that the difference is equal to or smaller than the predetermined allowable value.

On the other hand, in the case where it is determined that the difference is equal to or smaller than the predetermined allowable value, the recording apparatus may determine that the side edges of the recording target medium on the stacking section are already in an aligned state in a tidy manner. In this case, the movement of the edge guides is stopped, and then, the recording can be performed.

That is, in the case where the side edges of the recording target medium cannot be sufficiently aligned only by the onetime movement of the edge guides close to the recording target medium, the edge guides come in contact with the side edges of the recording target medium a plurality of times until it is determined that the difference is equal to or smaller than the predetermined allowable value. As a result, as compared with the case where the edge guides come in contact with the side edges of the recording target medium only one time, the side edges of the recording target medium can be aligned more firmly. That is, the side edges of the recording target medium can be aligned in a tidier manner.

According to a second embodiment of the invention, there is provided a recording apparatus including: a stacking section on which a recording target medium is stacked; edge guides which move in a width direction of the recording target medium and align side edges of the recording target medium which is stacked on the stacking section; a motor which moves the edge guides; a determining section which determines whether an electric current value at the time when the motor is driven reaches a predetermined threshold value; and a position detecting section which detects a position of the edge guides in the width direction, wherein when the side edges of the recording target medium are aligned, the edge guides move close to the recording target medium by means of power of the motor while the electric current value is being monitored by the determining section, and a position of the edge guides at the time when the electric current value reaches the predetermined threshold value is stored, wherein the edge guides move away from the recording target medium by means of the power of the motor, and then, the edge guides move close to the recording target medium while the electric current value is being monitored and it is determined whether a difference between a position of the edge guides at the time when the electric current value reaches the predetermined threshold value and the stored position of the edge guides is equal to or smaller than a predetermined allowable value, and wherein if it is determined that the difference is not equal to or smaller than the predetermined allowable value, the edge guides move away from the recording target medium by means of the power of the motor, and then, the edge guides move close to the recording target medium until the electric current value reaches the predetermined threshold value while the electric current value is being monitored.

According to the second embodiment, in the case where it is determined that the difference is not equal to or smaller than the predetermined allowable value, the recording apparatus may determine that the side edges of the recording target medium on the stacking section are in a non-aligned state. Thus, the edge guides may strike the side edges of the recording target medium once again, so as to align the side edges of the recording target medium in a tidier manner. That is, it is possible to achieve the same effect as in the first embodiment.

On the other hand, in the case where it is determined that the difference is equal to or smaller than the predetermined allowable value, the recording apparatus may determine that the side edges of the recording target medium on the stacking section are already in an aligned state in a tidy manner.

Further, according to the second embodiment, the edge guides strike the side edges of the recording target medium at least two times. Due to the strikes of the plurality of times, it is possible to easily loosen a bundle of the recording target mediums, compared with a case where the edge guides strike the side edges of the recording target medium only one time. Specifically, in a case where the stacked recording target mediums may tightly cling to each other, it is possible to generate a slight gap between the recording target mediums which cling to each other, to thereby loosen the bundle of the recording target mediums. In particular, this is effective in the case of a bundle of new recording target mediums since the new recording target mediums tend to cling to each other. In particular, in a case where the recording target medium is a recording paper, the recording target mediums tend to cling to each other through a cutting process. As a result, it is likely that the recording target mediums are fed toward a downstream side along a feeding direction in an overlapped state. That is, according to the present embodiment, the recording target medium can be fed sheet by sheet.

According to a third embodiment of the invention, there is provided a recording apparatus as in the first and second embodiments, wherein when the operation of aligning the side edges of the recording target medium is performed, the edge guides move close to the recording target medium in a movable range of the edge guides, wherein in a case where the electric current value reaches the predetermined threshold value in a position exceeding a position corresponding to the recording target medium having a minimum usable size, an operation of enabling the edge guides to come into contact with the side edges of the recording target medium is performed a plurality of times, and wherein in the case where the electric current value reaches the predetermined threshold value in the position exceeding the position corresponding to the recording target medium having the minimum usable size, the edge guides move away from the recording target medium and then stop.

According to the third embodiment, in addition to the same effects as in the first or second embodiment, there is a case where the electric current value reaches the predetermined threshold value in the position exceeding the position corresponding to the recording target medium having the minimum usable size. In this case, the recording apparatus may determine that the recording target medium is not present on the stacking section, with respect to the presence or absence of the recording target medium on the stacking section. Thus, the edge guides may move away from the recording target medium and then stop.

Accordingly, a user can set a recording target medium on the stacking section. That is, if the edge guides are positioned adjacent to the recording target medium, the edge guides obstruct the setting action of the user. However, in the present embodiment, since the edge guides move away from the recording target medium and stop, the risk of the obstruction can be removed.

Further, as it is determined that the recording target medium is not present, it is possible to stop the operation of enabling the edge guides to come into contact with the side edges of the recording target medium a plurality of times. That is, it is possible to prevent an unnecessary operation.

According to a fourth embodiment of the invention, there is provided a recording apparatus as in any one of the first, second and third embodiments, further including: a feeding unit which feeds the recording target medium to a recording section which is installed on a downstream side from the stacking section in a feeding direction; and a sensor which measures the amount of the recording target medium fed by the feeding unit, wherein the motor serves as a motor which drives the feeding unit, and wherein the position detecting section performs detection using the sensor.

According to the fourth embodiment, in addition to the same effects as in any one of the first, second and third embodiments, it is possible to move the edge guides using the power of the motor which drives the feeding unit. Thus, it is unnecessary to provide an exclusive use motor for moving the edge guides only.

Further, it is possible to calculate the amount of the movement of the edge guides using the sensor which measures the recording target medium fed by the feeding unit.

Accordingly, it is possible to specify a current position of the edge guides. As a result, the recording apparatus can determine the presence or absence of the recording target medium by specifying the position of the edge guides at the time when the motor is stopped. That is, it is unnecessary to separately provide an exclusive use detector for detecting the presence or absence of the recording target medium in the stacking section.

Further, the recording apparatus can recognize the size of the recording target medium. That is, it is unnecessary to separately provide an exclusive use detector for detecting the size of the recording target medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to accompanying drawings.

Figure 1:
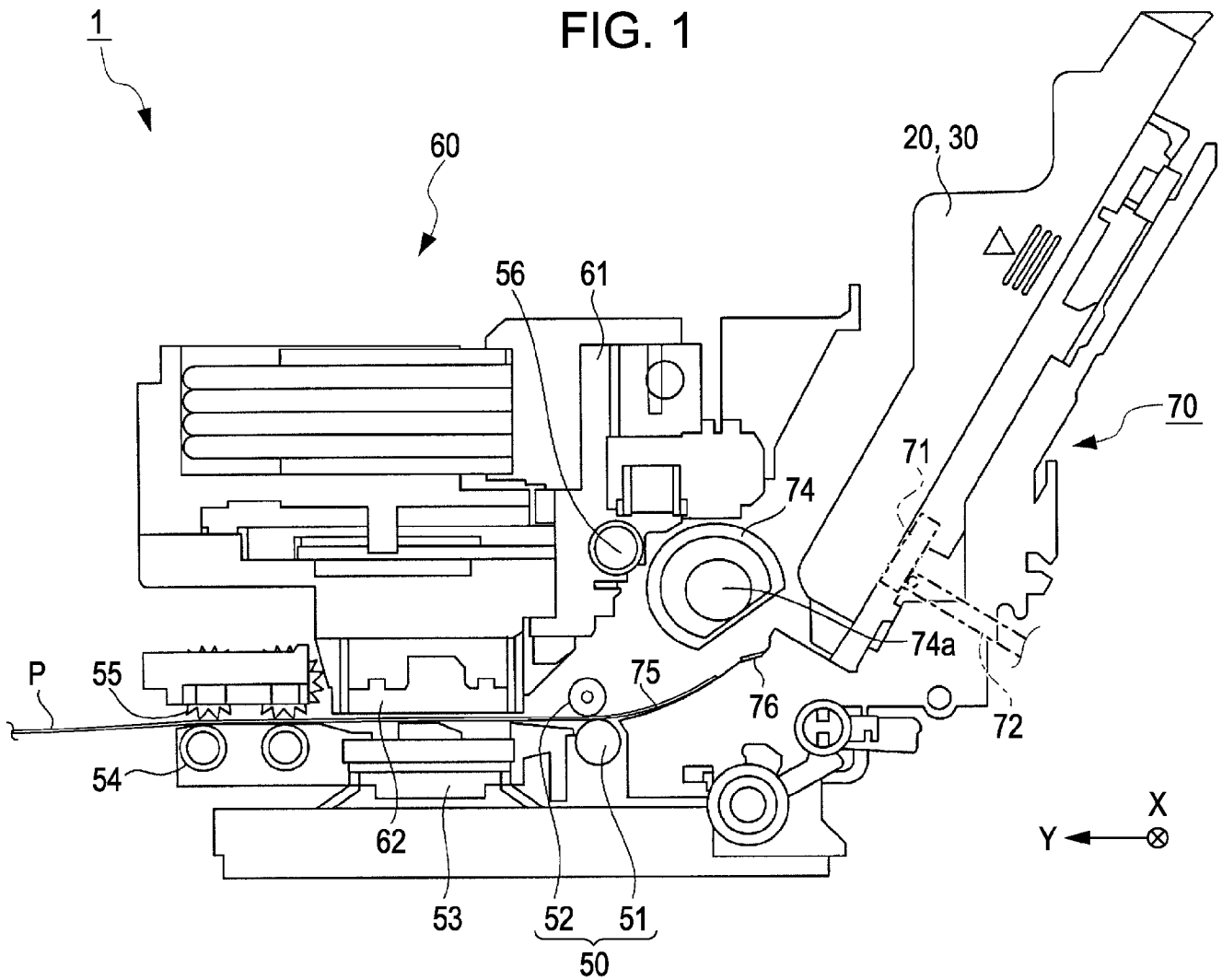
FIG. 1 is an overall side view illustrating a recording apparatus according to an embodiment of the invention.

FIG. 1 is an overall side view schematically illustrating a recording apparatus which is an example of a liquid ejecting apparatus according to an embodiment of the invention.

Here, the liquid ejecting apparatus includes a recording apparatus such as an ink jet type recording apparatus in which ink is ejected from a recording head which is a liquid ejecting head to a recording target material such as a recording paper to perform recording with respect to the recording target material, a facsimile and a copier, and further includes an apparatus in which a liquid having a specific usage instead of the ink is ejected from a liquid ejecting head corresponding to the recording head to an ejecting target material corresponding to the recording target material to adhere the liquid to the ejecting target material.

The liquid ejecting head includes, as well as the recording head, a color material ejecting head used for manufacturing a color filter of a liquid crystal display or the like, an electrode material (conductive paste) ejecting head used for forming an electrode of an organic electroluminescence (EL) display, a field emission display (FED) or the like, a bioorganic material ejecting head used for manufacturing biochips, a specimen ejecting head for ejecting specimens which is a precise pipette, or the like.

A recording apparatus 1 includes a feeding unit 70 as an automatic feeding device for feeding a recording paper P which is a recording target material to the inside of the recording apparatus 1. Further, the recording apparatus 1 includes a transport driving roller 51 and a transport driven roller 52 as a transport unit 50 for transporting the recording paper P which is supported on a paper support 53 in a transport direction Y. Further, the recording apparatus 1 includes a recording head 62 as a recording section 60 for ejection of ink onto a recording surface of the recording paper P which is supported on the paper support 53 to perform recording. Further, the recording apparatus 1 includes a discharge driving roller 54 and a discharge driven roller 55 as a discharge unit for discharging the recording paper P after the recording is performed in the transport direction Y.

Figure 2:
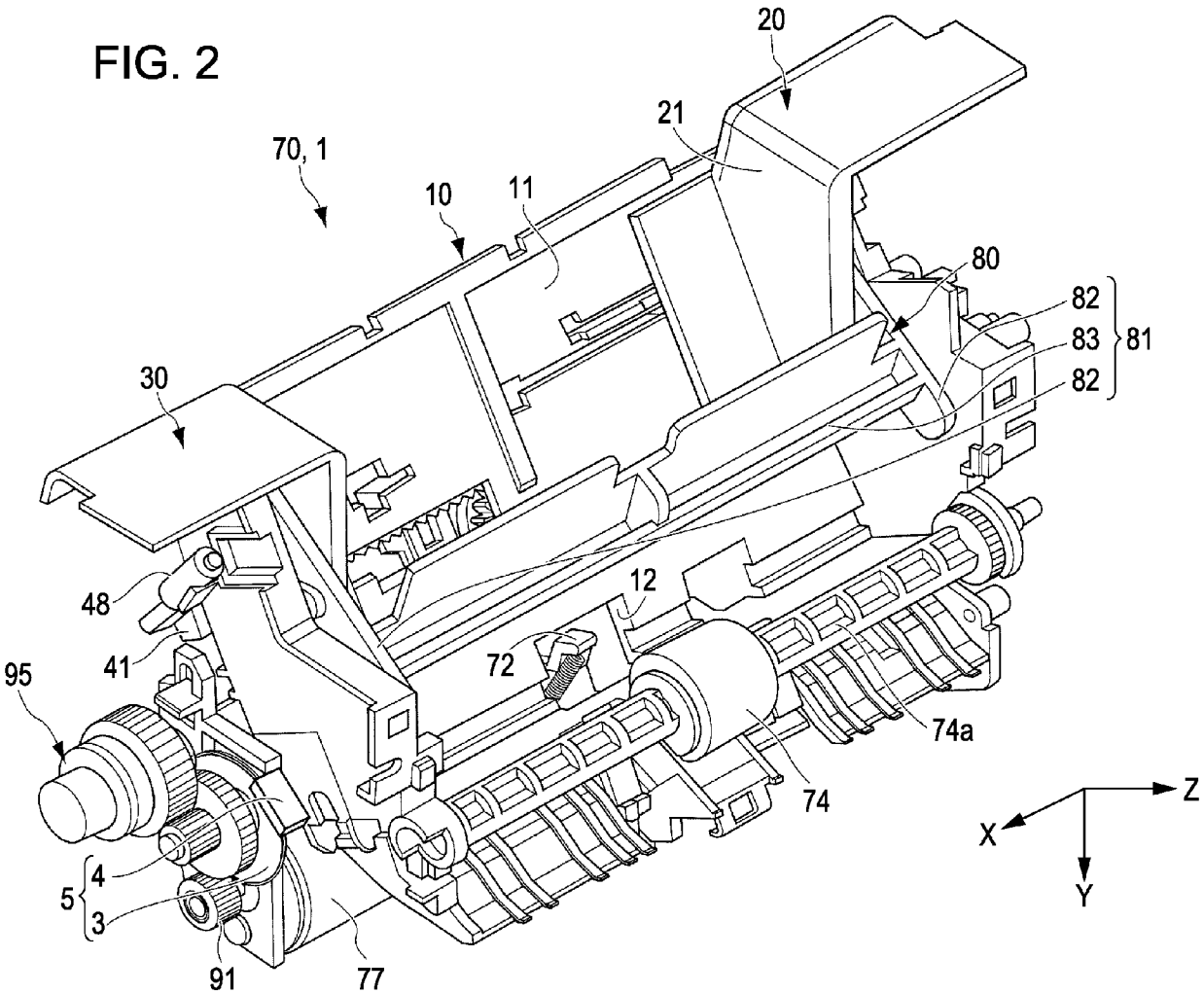
FIG. 2 is a front perspective view illustrating a feeding unit according to an embodiment of the invention.

The feeding unit 70 includes a hopper 71, a first edge guide 20 on the left side, a second edge guide 30 (FIG. 2) on the right side, a feeding roller 74, a feeding path 75, a separation pad 76 and a feeding motor 77 (FIG. 2).

The hopper 71 on which the recording paper P is loaded and stacked is shaft-supported to a base of the feeding unit 70 to be able to swing toward the feeding roller 74. The first edge guide 20 and the second edge guide 30 are supported to be able to slide in a width direction X (a direction crossing the transport direction Y) according to the size of the recording paper P which is stacked.

The feeding roller 74 is integrally provided to a feeding roller shaft 74*a* which is shaft-supported to a base (see FIG. 2) of the feeding unit 70, and rotates as the feeding roller shaft 74*a* rotates by a rotation driving force of the feeding motor 77. In this embodiment, the feeding motor 77 is a DC motor.

In this respect, the DC motor uses direct current power, and includes a so-called brush DC motor or brushless motor but does not include a stepping motor which is driven in proportion to the number of input pulses.

The recording paper P which is stacked on the hopper 71 is in a state of being in contact with an outer circumferential surface of the feeding roller 74 as the hopper 71 swings toward the feeding roller 74. Thus, according to the rotation of the feeding roller 74, the recording paper P is fed through the feeding path 75 toward a region where the transport driving roller 51 and the transport driven roller 52 are in contact with each other. At this time, double-feeding of the recording paper P is prevented by means of the known separation pad 76.

The transport driving roller 51 has a surface on which a high frictional coating is processed and rotates by the rotation driving force of the feeding motor 77.

Alternatively, it is possible to provide a separate transport motor. The transport motor may be provided as a DC motor, but may be preferably provided as a stepping motor. This is used for controlling the driving amount of the transport driving roller 51 with high accuracy.

The transport driven roller 52 is shaft-supported to be able to rotate while being driven and is biased in a state where the transport driven roller 52 is in contact with a circumferential surface of the transport driving roller 51 by a biasing unit such as a spring (not shown). The recording paper P which is fed by the feeding unit 70 is pinched between the transport driving roller 51 and the transport driven roller 52, and is transported on the paper support 53 by the driving rotation of the transport driving roller 51 in the transport direction Y.

The recording head 62 is arranged on a bottom of a carriage 61. On a head surface of the recording head 62, a plurality of ejecting nozzles (not shown) for ejecting ink is installed.

The carriage 61 is supported on the carriage guide shaft 56 to be able to reciprocally move in the width direction X while maintaining a state where the head surface of the recording head 62 and a recording surface of the recording paper P on the paper support 53 become approximately parallel. An endless belt (not shown) is provided between a driving pulley (not shown) which is installed to a rotation shaft of a carriage driving motor (not shown) and a driven pulley (not shown) which is shaft-supported to be able to rotate. Further, the carriage 61 to which the endless belt is connected reciprocally moves in the width direction X as a rotation driving force of the carriage driving motor is transmitted thereto through the endless belt.

The paper support 53 includes a plurality of ribs in the width direction X of the recording paper P. The recording paper P which is transported on the paper support 53 is supported on a top surface of the ribs from a rear surface side thereof. Recording is performed in a region of the recording paper P which is supported on the paper support 53 by forming dots on the recording surface of the recording paper P by ejecting ink from the head surface of the recording head 62. An interval between the head surface of the recording head 62 and the recording surface of the recording paper P is regulated to an appropriate interval due to the top surface of the rib.

By alternately repeating an operation in which the carriage 61 ejects ink to the recording surface of the recording paper P from the head surface of the recording head 62 while reciprocally moving in the width direction X to form the dots and an operation in which the carriage 61 is transported in the transport direction Y with a predetermined transport amount by the driving rotation of the transport driving roller 51, recording is performed onto the recording surface of the recording paper P which is transported on the paper support 53. The recording paper P after ejection of the ink is pinched between the discharge driving roller 54 and the discharge driven roller 55, and is transported and discharged in the transport direction Y by the driving rotation of the discharge driving roller 54. The above described series of recording controls is performed by a controller 2 (see FIGS. 3 and 4) having a microcomputer control circuit.

Further, a hopper lever inserting hole 12 (see FIG. 2), through which a hopper lever 72 is inserted, is formed in a position which is opposite to the feeding roller 74 in the base 10. In this embodiment, the hopper lever 72 swings in conjunction with the rotation of the feeding roller 74. Thus, the hopper lever 72 enables the hopper 71 to move close to or away from the feeding roller 74. In addition, the recording paper P which is stacked on a paper stacking section 11 in the base 10 is pressed on the feeding roller 74 by the hopper 71, and thus is fed toward a downstream side in a feeding direction.

In FIG. 1, a pressing unit 80 (see FIG. 2) is not shown, which will be described later.

FIG. 2 is a front perspective view illustrating the feeding unit according to an embodiment of the invention. Further, FIG. 3 is a schematic side view illustrating the feeding unit according to an embodiment of the invention.

Figure 3:
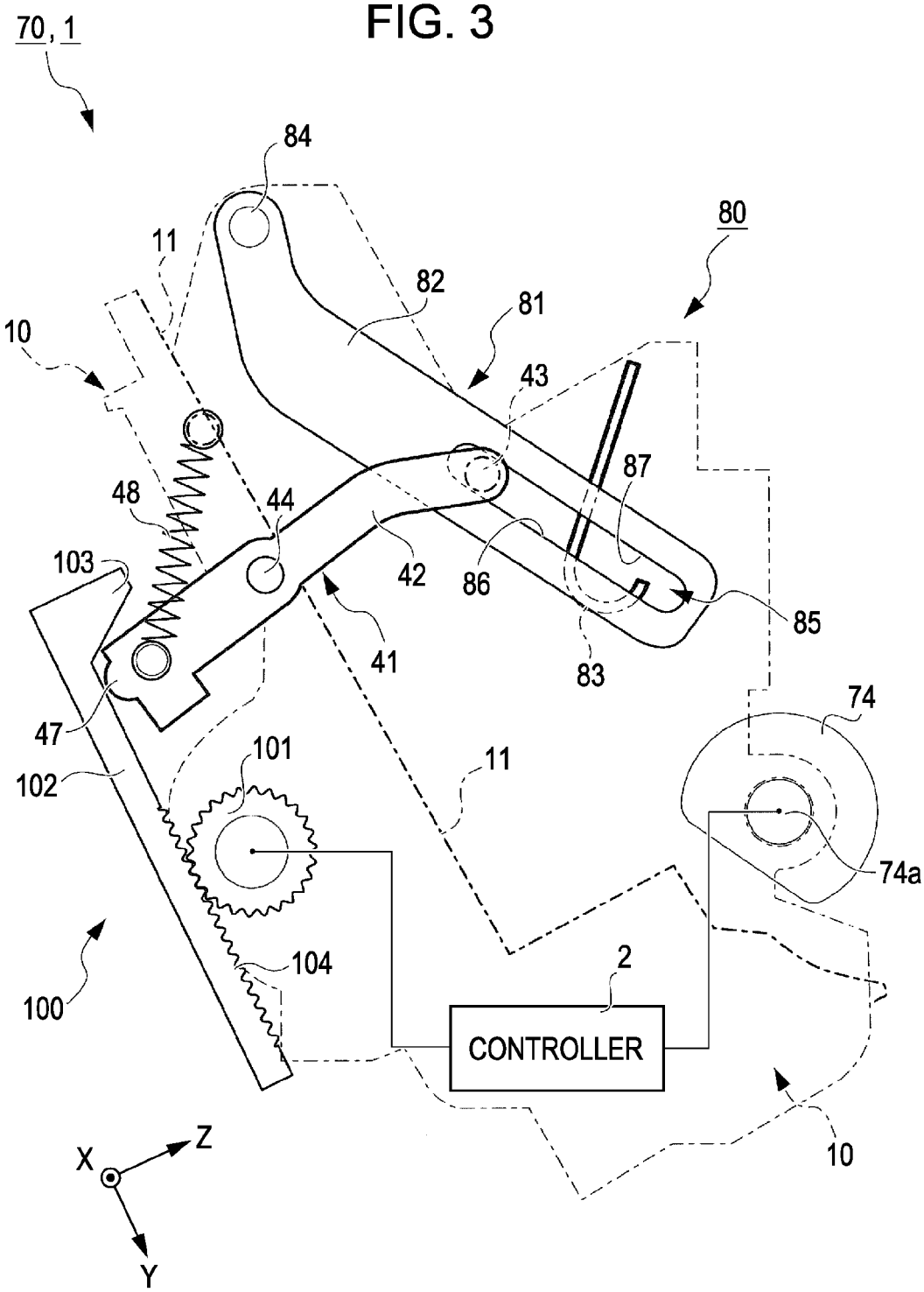
FIG. 3 is a schematic side view illustrating a feeding unit according to en embodiment of the invention.

As shown in FIGS. 2 and 3, the feeding unit 70 of the recording apparatus 1 includes the base 10, the first edge guide 20, the second edge guide 30 and the pressing unit 80. The pressing unit 80 is installed to prevent the above described uplifting of the stacked recording paper P. Specifically, the pressing unit 80 includes a pressing lever 81, an engaging lever 41, and a lever swing unit 100.

The pressing lever 81 includes a pair of pressing arm sections 82 and 82, a pair of first support shafts 84 and 84, a paper contact section 83, and a pair of guide section 85 and 85. The pair of pressing arm sections 82 and 82 is installed outside the pair of edge guides 20 and 30 in the width direction. Further, the pressing lever 81 is engaged with the base 10 in the first support shafts 84 and 84, and is swung around the first support shafts 84 and 84. In addition, the paper contact section 83 is formed between the pair of pressing arms 82 and 82 and is installed to be in contact with the recording paper P. The pressing lever 81 is installed in an approximately inverted U shape when seen from a Y-axial arrow direction.

Further, the guide sections 85 and 85 are formed in the pair of pressing arms 82 and 82, and are formed to able to guide engaging protrusion sections 43 and 43 of the engaging lever 41 which will be described later. Specifically, the guide sections 85 and 85 are formed in an elongated hole shape which is extended in a direction distant from the first support shafts 84 and 84 in the pair of pressing arm sections 82 and 82. First flat sections 87 and 87 are formed on long and smooth surfaces which are positioned in upper sides of the guide sections 85 and 85 in the stacking direction. Similarly, second flat sections 86 and 86 are formed on the other long and smooth surfaces which are positioned in lower sides in the stacking direction, which are opposite to the first flat sections 87 and 87.

Hereinafter, since the pair of pressing arm sections 82 and 82 is bilaterally symmetric, one pressing arm section will be described and description of the other one will be omitted. This is the same as in the first support shafts 84, the guide sections 85, etc.

Further, the engaging lever 41 includes the pair of engaging arm sections 42 and 42, the pair of engaging protrusion sections 43 and 43, second support shafts 44 and 44, and a slide contact section 47. The engaging lever 41 is installed in an approximate U shape when seen from the Y-axial arrow direction. In other words, the pair of engaging arm sections 42 and 42 is connected by the slide contact section 47 which is extended in the X axis direction. In addition, each of the engaging protrusion sections 43 and 43 are installed in one end part of each of the pair of engaging arm sections 42 and 42.

Moreover, the engaging lever 41 is engaged with the base 10 in the second support shafts 44 and 44 and is installed to be able to swing around the second support shafts 44 and 44. The pair of engaging protrusion sections 43 and 43 is respectively formed to be able to move inside the pair of guide sections 85 and 85 of the pressing lever 81.

Hereinafter, since the pair of engaging arm sections 42 and 42 are bilaterally symmetric, one engaging arm section will be described and description of the other one will be omitted. This is the same as in the second support shafts 44, the engaging protrusion sections 43, etc.

Further, an end of a spring 48 is coupled with the other end part of the engaging lever 41, and the other end of the spring 48 is coupled with the base 10, and thus, the engaging lever 41 is biased in a clockwise direction in FIG. 3.

Here, a posture of the engaging lever 41 is determined by the lever swing unit 100 and the spring 48.

The lever swing unit 100 includes a pinion gear 101, a slide section 102, a rack section 104, and a pressing section 103. The pinion gear 101 is driven by power of the feeding motor 77 through a clutch mechanism 95 which will be described later. Further, the slide section 102 is provided with the rack section 104 which is engaged with the pinion gear 101, and the pressing section 103, and slides in the Y axis direction while being guided by the base 10. Moreover, the pressing section 103 is configured to be contacted and pressed against the slide contact section 47 of the engaging lever 41.

Further, if the slide section 102 slides in the Y-axial arrow direction, the pressing section 103 presses the slide contact section 47 which will be specifically described, and is configured so that the engaging lever 41 can slide in the counterclockwise direction in FIG. 3. On the other hand, if the slide section 102 slides in a direction opposite to the Y-axial arrow direction, the pressing section 103 moves to be withdrawn from the slide contact section 47. In addition, the engaging lever 41 is configured to slide in the clockwise direction in FIG. 3 by a biasing force of the spring 48.

Here, a relationship between the pressing lever 81 and the engaging lever 41 will be described. The pressing lever 81 is installed to be able to swing as the engaging lever 41 swings.

Specifically, when the engaging lever 41 swings in the counterclockwise direction in FIG. 3, the engaging protrusion section 43 moves to be close to the first support shaft 84, being in contact with the first flat section 87 of the guide section 85. Accordingly, the pressing lever 81 moves up in a Z-axial arrow direction which is a stacking direction of the recording paper P. That is, the pressing lever 81 swings in the counterclockwise direction in FIG. 3.

On the other hand, when the engaging lever 41 swings in the clockwise direction in FIG. 3, the engaging protrusion section 43 moves in a direction which is distant from the first support shaft 84, while being in contact with the first flat section 87 of the guide section 85. Accordingly, the pressing lever 81 moves down in a direction opposite to the Z-axial arrow direction due to the weight of the pressing lever 81 while supporting the pressing lever 81. That is, the pressing lever 81 swings in the clockwise direction in FIG. 3.

Instead of the weight of the pressing lever 81, a biasing means such as a spring may be used.

Further, a rotary encoder 3 and an encoder sensor 4 for detecting the driving amount of the feeding motor 77 are installed around the feeding motor 77. In this embodiment, the movement amount of the edge guides 20 and 30 can be calculated by the rotary encoder 3 and the encoder sensor 4. In addition, a current position of the edge guides 20 and 30 can be specified on the basis of the movement amount of the edge guides 20 and 30. That is, a position detecting section 5 which detects a position of the edge guides 20 and 30 performs the detection using the rotary encoder 3 and the encoder sensor 4 which are installed for detection of the driving amount of the feeding motor 77.

Figure 4:
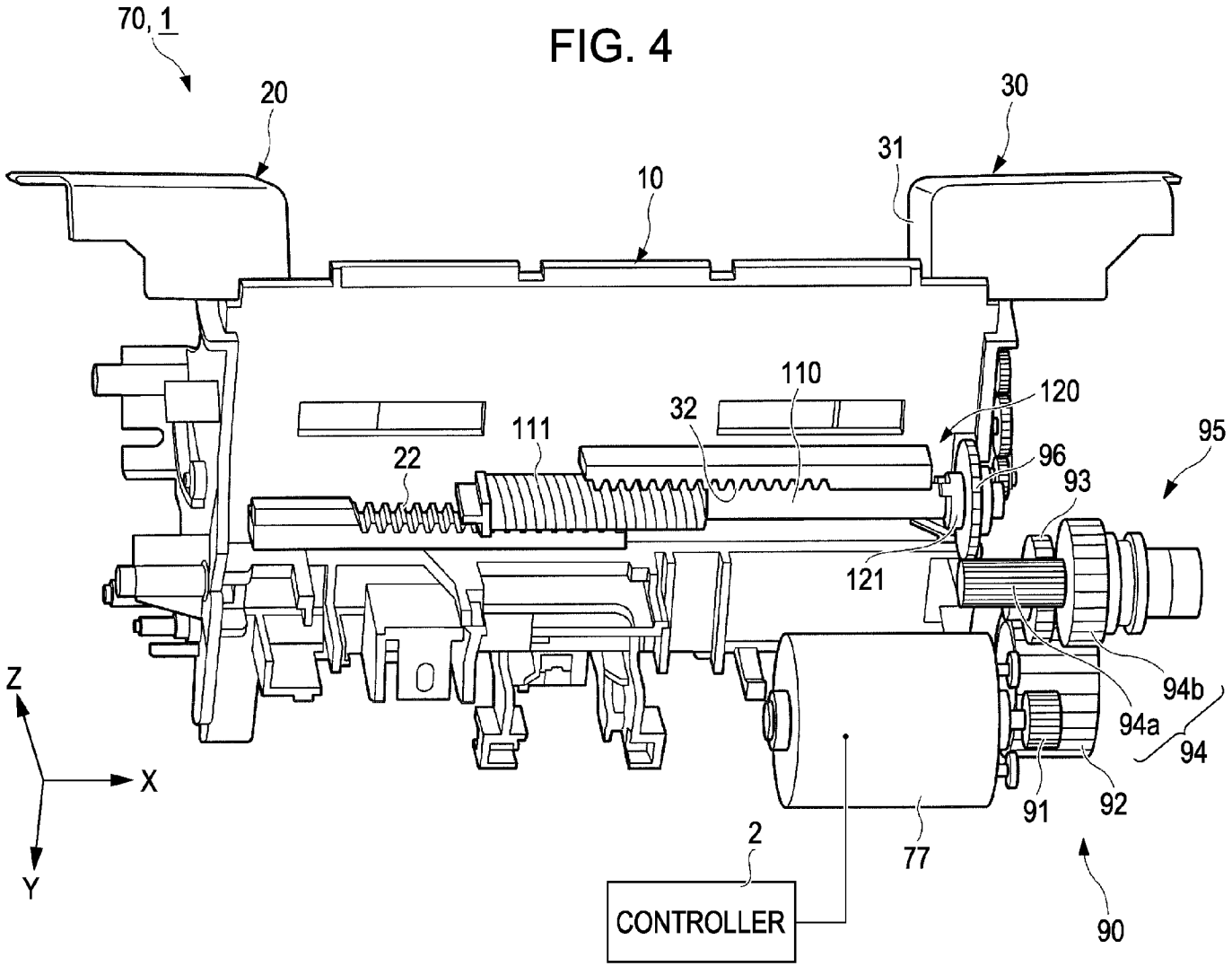
FIG. 4 is a rear perspective view illustrating a feeding unit according to an embodiment of the invention.

FIG. 4 is a rear perspective view illustrating the feeding unit according to an embodiment of the invention.

As shown in FIG. 4, the feeding unit 70 includes the pair of edge guides 20 and 30 which move in the width direction X of the recording paper P with respect to the base 10. Specifically, the feeding unit 70 includes the first edge guide 20 in the right side from a front view (see FIG. 2) of the feeding unit 70 and the second edge guide 30 in the left side thereof.

In FIG. 4, the pressing unit 80 is omitted for easy understanding of description in FIG. 4.

Further, the first edge guide 20 and the second edge guide 30 are installed to be able to align the recording paper P which is stacked on the paper stacking section 11 of the base 10 as the first edge guide 20 and the second edge guide 30 moves inside from outside in the width direction.

In addition, the feeding unit 70 includes a power transmission mechanism 90 which transmits the power of the feeding motor 77 to the first edge guide 20, the second edge guide 30 and the engaging lever 41, which will be described in detail.

The power transmission mechanism 90 includes a motor pinion 91, a first gear 92, a second gear 93, a first complex gear 94, the clutch mechanism 95, a fifth gear 96, a time lag mechanism 120, a power transmission shaft 110, a worm 111, a first helical rack 22 and a second helical rack 32. The motor pinion 91 is installed in the feeding motor 77 and transmits the power to the first gear 92.

The first gear 92 transmits the power to the second gear 93 and the second gear 93 transmits the power to a third gear 94*a* of the first complex gear 94. Here, the first complex gear 94 includes the third gear 94*a* and a fourth gear 94*b* which have different radii on the same shaft. The third gear 94*a* is installed to be switched by the clutch mechanism 95 between a power transmission connection state where the power is transmitted to the fifth gear 96 and a power transmission cutoff state where the power is not transmitted. On the other hand, the fourth gear 94*b* is configured to transmit the power to the hopper lever 72, the feeding roller 74, the transport driving roller or the like through any other gear train (not shown).

In this embodiment, the clutch mechanism 95 includes a contact lever (not shown) which comes in contact with the carriage 61 when the carriage 61 is positioned in a downstream side edges in the X-axial arrow direction in the width direction X of the recording paper P, and a biasing spring (not shown) which biases the contact lever toward an upstream side in the X-axial arrow direction in the width direction X. Further, as the carriage 61 swings the contact lever toward the downstream side in the X-axial arrow direction in the width direction X against a biasing force of the biasing spring, the first complex gear 94 moves toward the upstream side in the X-axial arrow direction in the width direction X of the recording paper P.

Accordingly, the clutch mechanism 95 can be switched into the power transmission connection state where the third gear 94*a* is engaged with the fifth gear 96.

On the other hand, when the carriage 61 moves toward the upstream side in the X-axial arrow direction in the width direction X and is spaced from the contact lever, the contact lever swings toward the upstream side in the X-axial arrow direction in the width direction X due to the biasing force of the biasing spring. Accordingly, the first complex gear 94 moves toward the downstream side in the X-axial arrow direction in the width direction X of the recording paper P.

Accordingly, the clutch mechanism 95 can be switched into the power transmission cutoff state where the third gear 94*a* is not engaged with the fifth gear 96.

The fifth gear 96 is installed to be able to rotate with respect to the power transmission shaft 110 on the power transmission shaft 110. Further, the fifth gear 96 is installed to transmit the power to the power transmission shaft 110 through the time lag mechanism 120.

Here, the time lag mechanism 120 is configured to transmit the power of the fifth gear 96 to the power transmission shaft 110 when the rotation amount of the fifth gear 96, after the fifth gear 96 starts to rotate in one direction, reaches a predetermined amount.

Specifically, the time lag mechanism 120 includes a first convex section (not shown) which is formed in the fifth gear 96, a ring section 121, a second convex section (not shown) and a third convex section (not shown) which are formed in the ring section 121, and a fourth convex section (not shown) which is formed in the power transmission shaft 110. The fifth gear 96 and the ring section 121 are installed to be able to rotate with respect to the power transmission shaft 110 on the power transmission shaft 110.

Firstly, the fifth gear 96 starts to rotate in one direction, and the first convex section (not shown) of the fifth gear 96 is engaged with the second convex section (not shown) of the ring section 121, right before one rotation is completed.

Next, the fifth gear 96 and the ring section 121 integrally rotate in the same direction, and the third convex section (not shown) of the ring section 121 is engaged with the fourth convex section (not shown) of the power transmission shaft 110, right before the ring section 121 rotates one time.

Further, the fifth gear 96, the ring section 121 and the power transmission shaft 110 are integrally formed to rotate in the same direction.

That is, when the rotation amount of the fifth gear 96 in one direction reaches a predetermined rotation amount, the power is transmitted to the power transmission shaft 110. This is the same in a case where the fifth gear 96 starts to rotate in a reverse direction is the same. Here, a timing when the rotation is stopped is the same as in the fifth gear 96 and as in the power transmission shaft 110.

Without installing the time lag mechanism 120, a motor which moves the edge guides 20 and 30 and a motor which moves the pressing lever 81 may be independently installed.

The power transmission shaft 110 transmits the power to the first helical rack 22 which is integrally installed with the first edge guide 20 through the worm 111 which is integrally formed together with the power transmission shaft 110, and to the second helical rack 32 which is integrally installed with the second edge guide 30. Accordingly, the first edge guide 20 and the second edge guide 30 can be moved in the width direction X of the recording paper P. At this time, the movement of the first edge guide 20 and the second edge guide 30 can be bilaterally symmetric. That is, the first edge guide 20 and the second edge guide 30 can move to be closed inward in the width direction and can move to be opened outward in the width direction reversely.

The first edge guide 20 and the second edge guide 30 are installed to move by means of configurations of the worm 111, the first helical rack 22 and the second helical rack 32, but are not limited thereto. The first edge guide 20 and the second edge guide 30 may be installed to move by means of a so-called rack and pinion configuration.

Subsequently, operations of the first edge guide 20, the second edge guide 30 and the pressing lever 81 until the feeding starts after the recording paper P is set in the paper stacking section 11 will be described in detail.

When a Recording Paper is Set

Figure 5A:
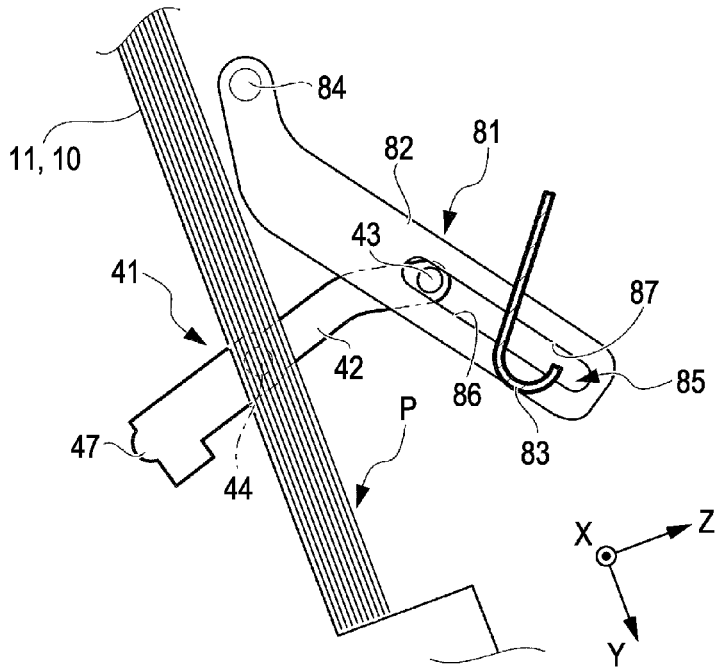
FIGS. 5A and 5B are diagrams illustrating an operation of a feeding unit according to an embodiment of the invention (when a recording paper is set).
Figure 5B:
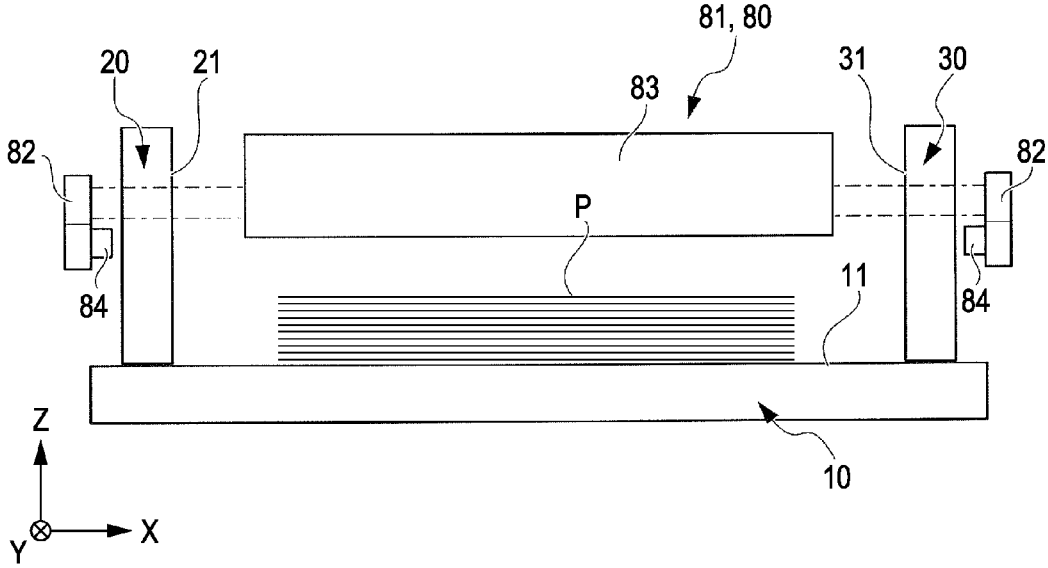

FIGS. 5A and 5B are schematic diagrams illustrating the feeding unit when a recording paper is set, in which FIG. 5A is a side view, and FIG. 5B is a diagram when seen from an upstream side in the feeding direction.

As shown in FIGS. 5A and 5B, when the recording paper P is set on the paper stacking section 11, the first edge guide 20 and the second edge guide 30 are in a fully opened state outward in the width direction. Further, the paper contact section 83 of the pressing lever 81 is in a fully moved up state upward in the stacking direction.

Specifically, in a state where the slide section 102 slides in the Y-axial arrow direction, the engaging lever 41 is in the state of being in contact with the pressing section 103. Thus, a user can easily set the recording paper P on the paper stacking section 11.

The carriage 61 is in contact with the contact lever (not shown) and power transmission of the power transmission mechanism 90 is in a connection state.

Paper Pressing Operation

Figure 6A:
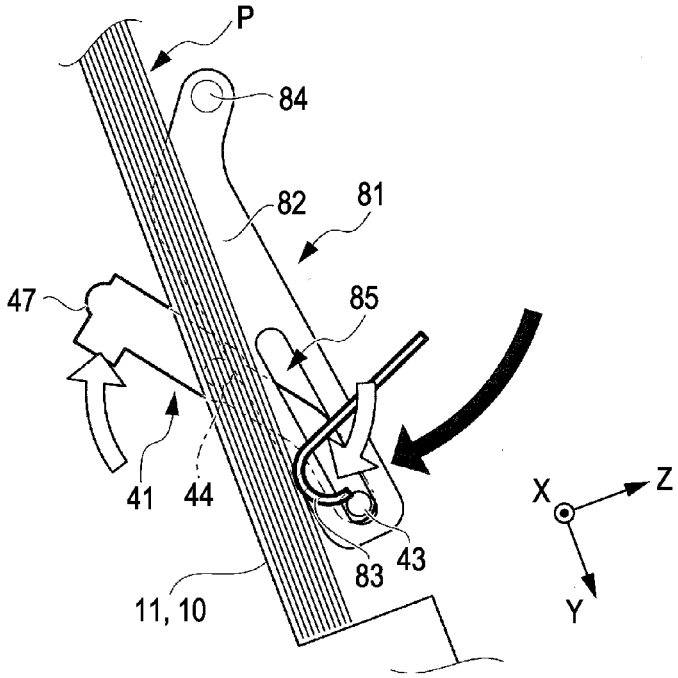
FIGS. 6A and 6B are diagrams illustrating an operation of a feeding unit according to an embodiment of the invention (a pressing operation).
Figure 6B:
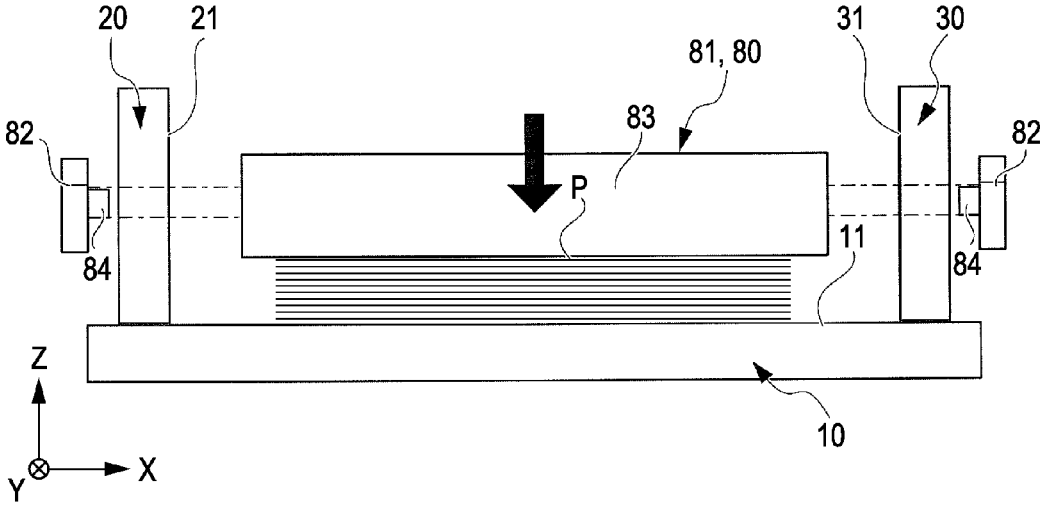

FIGS. 6A and 6B are schematic diagrams illustrating the feeding unit when a paper pressing operation is performed, in which FIG. 6A is a side view, and FIG. 6B is a diagram when seen from the upstream side in the feeding direction.

As shown in FIG. 6A, if the feeding motor 77 is driven from the state in FIGS. 5A and 5B, the slide section 102 slides in a direction opposite to the Y-axial arrow direction. Further, since the pressing section 103 moves in a spaced direction, the engaging lever 41 swings in the clockwise direction in the figure by the biasing force of the spring 48.

At this time, the self-weight is applied to the pressing lever 81. Thus, the pressing lever 81 swings in the clockwise direction by the self-weight while being supported on the engaging protrusion section 43 as described above. That is, the paper contact section 83 of the pressing lever 81 moves close to the recording paper P.

As a result, as shown in FIGS. 6A and 6B, the paper contact section 83 of the pressing lever 81 comes in contact with the surface of the recording paper P.

At this time, the engaging protrusion section 43 moves in a direction which is distant from the first support shaft 84 while being in contact with the first flat section 87 in the guide section 85. That is, the engaging protrusion section 43 moves toward a tip end part which is a free end part of the pressing arm section 82. When the paper contact section 83 is in contact with the recording paper P, the engaging protrusion section 43 is spaced from the first flat section 87 of the guide section 85. Then, the engaging protrusion section 43 is close to the second flat section 86 and comes in contact with the second flat section 86.

Accordingly, the paper contact section 83 receives the biasing force of the spring 48 through a position where the engaging protrusion section 43 is in contact with the second flat section 86 and can press the surface of the recording paper P.

In this embodiment, the biasing force of the spring 48 is configured to be applied in a direction where the pressing lever 81 moves close to the recording paper P on the paper stacking section, but may provided as a so-called two-position stability mechanism. In other words, the spring 48 may be biased toward a position in which the pressing lever 81 moves up and a position in which the pressing lever 81 moves down. In such a case, the same effect can be also obtained.

Paper Side Edge Aligning Operation

Figure 7A:
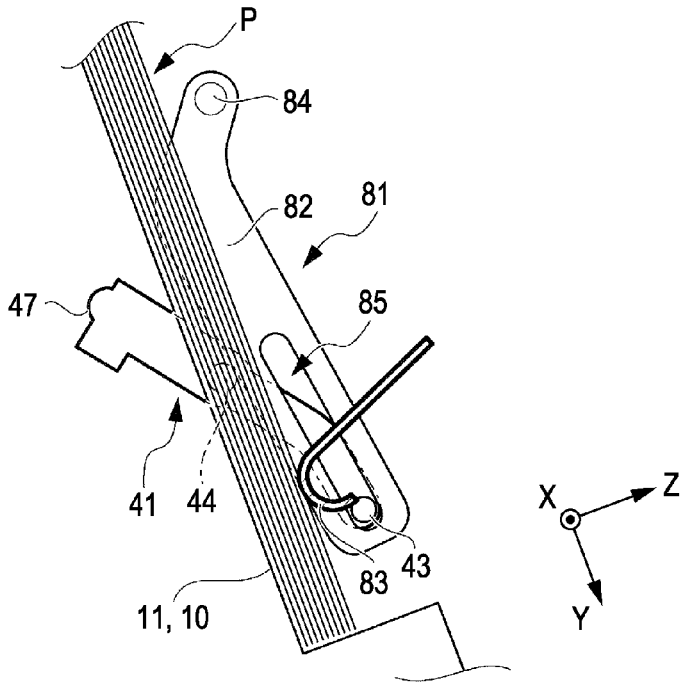
FIGS. 7A and 7B are diagrams illustrating an operation of a feeding unit according to an embodiment of the invention (when edge guides are closed).
Figure 7B:
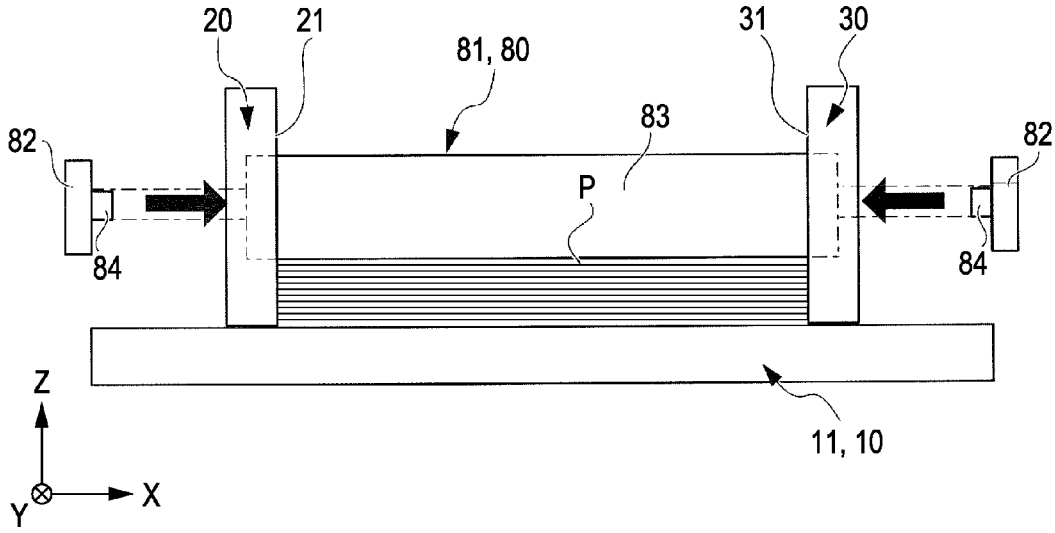

FIGS. 7A and 7B are schematic diagrams illustrating the time when a paper side edge aligning operation is performed, in which FIG. 7A is a side view, and FIG. 7B is a diagram when seen from the upstream side in the feeding direction.

As shown in FIGS. 7A and 7B, the feeding motor 77 is further driven from the state as shown in FIGS. 6A and 6B. Then, the power transmission shaft 110 starts to rotate by the above described time lag mechanism 120 (see FIG. 4). Specifically, if the rotation amount of the fifth gear 96 reaches a predetermined rotation amount, the first convex section (not shown) is engaged with the second convex section (not shown), and the third convex section (not shown) is engaged with the fourth convex section (not shown).

The fifth gear 96, the ring section 121 and the power transmission shaft 110 integrally rotate. Further, the worm 111 moves the first edge guide 20 inward in the width direction through the first helical rack 22. Similarly, the worm 111 moves the second edge guide 30 inward in the width direction through the second helical rack 32. That is, the worm 111 can move the first edge guide 20 and the second edge guide 30 to be closed inward in the width direction.

Further, a first guide surface 21 which is formed inward in the width direction in the first edge guide 20 comes in contact with one side edge of the recording paper P, and aligns side edges of the plurality of the recording papers P. Similarly, a second guide surface 31 which is formed inward in the width direction in the second edge guide 30 comes in contact with the other side edge of the recording paper P, and aligns the other side edges of the plurality of the recording papers P. In addition, the recording paper P is aligned in a center area in the width direction X by means of the first guide surface 21 and the second guide surface 31.

At this time, the controller 2 determines whether an electric current value of the feeding motor 77 reaches a predetermined threshold value, and determines whether the side edge of the recording paper P is aligned according to the determination.

Here, the "predetermined threshold value" is a value larger than an electric current value due to load at the time when the first edge guide 20 and the second edge guide 30 are individually in contact with one side edge of the recording paper P. Further, the predetermined threshold value is a value smaller than an electric current value due to load at the time when the first edge guide 20 and the second edge guide 30 are in contact with opposite side edges of the recording paper P of which the opposite side edges are aligned.

More specifically, in a state where one sheet of stacked recording paper P is pressed by the pressing unit 80, the predetermined threshold value is smaller than the electric current value due to the load at the time when the first edge guide 20 and the second edge guide 30 are in contact with the opposite side edges of this one sheet of recording paper P. That is, in the case of a configuration having the pressing unit 80, the predetermined threshold value is set considering that the stiffness of the recording paper P is increased by the pressing unit 80. In addition, the predetermined threshold value is set in consideration of a case where the number of stacked recording papers is small (for example, one sheet of paper).

Further, the predetermined threshold value is set considering that the stiffness of the recording paper or a frictional force between the recording papers in a stacked state is different according to the type of the recording paper.

Accordingly, in a case where the side edges of the plurality of recording papers P are not aligned, when the first guide surface 21 of the first edge guide 20 is in contact with the side edges of one sheet of recording paper P and the sheet of recording paper P is pressed inward in the width direction, the electric current value of the feeding motor 77 does not reach the predetermined threshold value.

Further, in a state where the first guide surface 21 and the second guide surface 31 are in contact with the side edges of the plurality of recording papers P, and the opposite side edges of the plurality of recording papers P are aligned, when the first edge guide 20 and the second edge guide 30 cannot further move inward in the width direction, the electric current value of the feeding motor 77 increases and reaches the predetermined threshold value. When the electric current value of the feeding motor 77 reaches the predetermined threshold value, the controller 2 temporarily stops the feeding motor 77.

At this time, in the case where the number of the recording paper P is small, since the recording paper P receives a force which is applied inward from the opposite side edges in the width direction, the force is applied so that a center part in the width direction X of the recording paper P is pressed upward in the stacking direction. That is, the recording paper P may be bent so that the center part of the recording paper P in the width direction X is uplifted.

Accordingly, the feeding unit 70 in this embodiment includes the above descried pressing unit 80. Thus, the surface of the recording paper P can be firmly pressed between the first edge guide 20 and the second edge guide 30.

As a result, the center part in the width direction X of the recording paper P can be prevented from being bent and being uplifted.

Further, as described later, the size of the recording paper P may be determined on the basis of the position of the edge guides 20 and 30 which are stopped in the state where the opposite side end edges of the recording paper P are aligned. The position of the edge guides 20 and 30 may be detected by the above described position detecting section 5.

Case where the Recording Paper is not Present

Figure 8A:
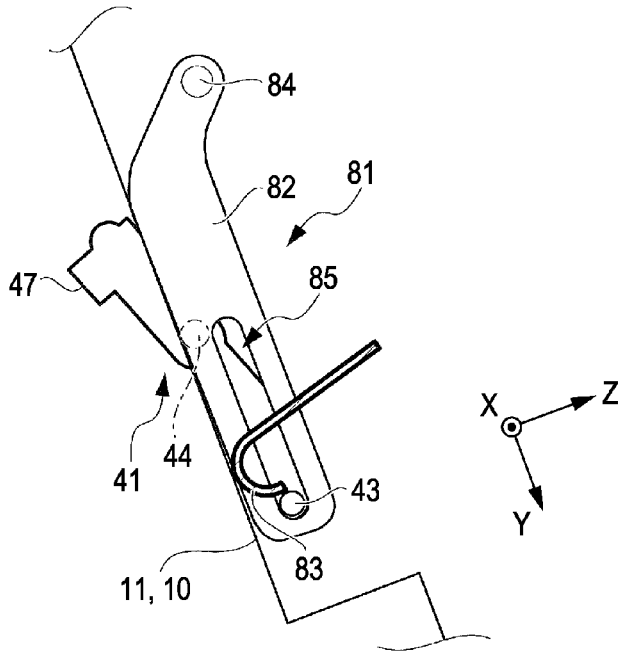
FIGS. 8A and 8B are diagrams illustrating an operation of a feeding unit according to an embodiment of the invention (when a recording paper is not present).
Figure 8B:
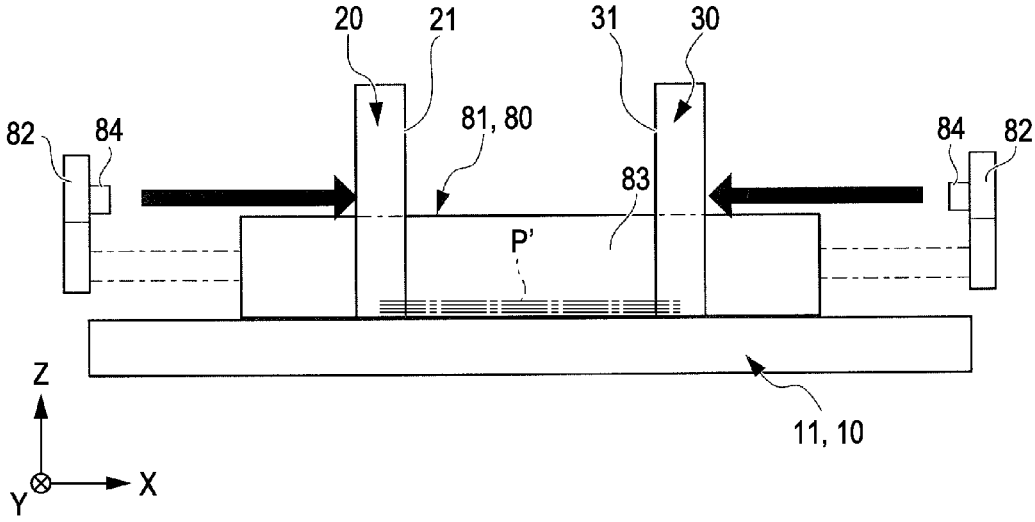

FIGS. 8A and 8B are schematic diagrams illustrating the feeding unit when the paper side edge aligning operation is performed in a case where the recording paper is not set in the paper stacking section, in which FIG. 8A is a side view, and FIG. 8B is a diagram when seen from the upstream side in the feeding direction.

As shown in FIGS. 8A and 8B, even in the case where the recording paper P is not set in the paper stacking section 11, the controller 2 performs the paper side edge aligning operation. That is, before the feeding operation is performed, the controller 2 moves the first edge guide 20 and the second edge guide 30 inward in the width direction. Further, the controller 2 may determine whether the recording paper P is present.

Specifically, there is a plurality of sizes of the recording papers which is capable of being set in the paper stacking section 11 of the recording apparatus 1. Further, the controller 2 enables the first edge guide 20 and the second edge guide 30 to move from the position in which the edge guides are fully opened to the position which are slightly inward from the position of the edge guides corresponding to a recording paper P' having a minimum size, while monitoring the electric current value of the feeding motor 77. At this time, on the basis of the fact that the electric current value of the feeding motor 77 does not reach the predetermined threshold value, the controller 2 can determine that no recording paper P of any size which is capable of being set is set in the paper stacking section 11.

When it is determined that the recording paper P is not set, the information that the recording paper is not set or that replacement of the recording paper is required is displayed on a display unit such as a liquid crystal display, to thereby request a user to set the recording paper.

That is, in a relatively early stage before the feeding operation is performed, the recording apparatus 1 can recognize that the recording paper P is not present. Accordingly, in the state where the recording paper P is not present in the paper stacking section 11, a hopper-up operation can be prevented. As a result, damage to the feeding roller 74 due to a direct collision of the hopper 71 and the feeding roller 74 can be prevented from being generated.

Recording Paper Press-releasing Operation

Figure 9A:
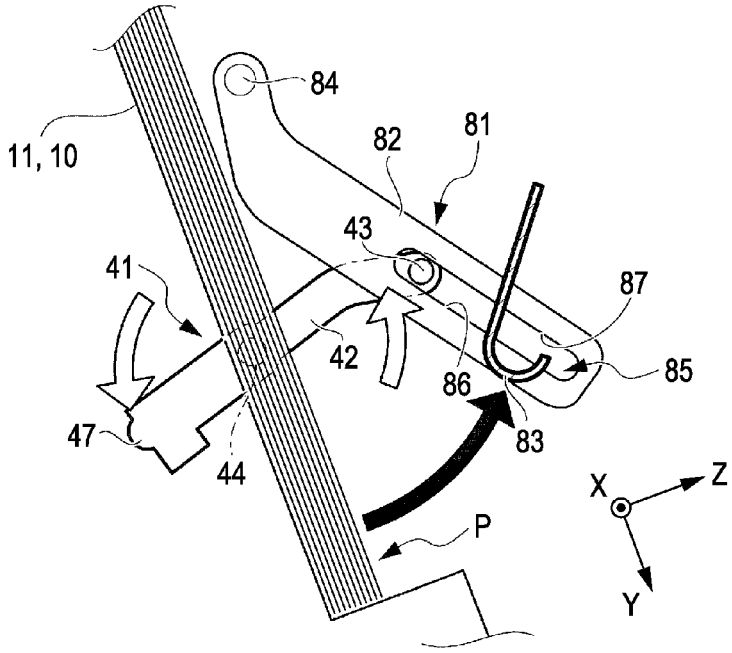
FIGS. 9A and 9B are diagrams illustrating an operation of a feeding unit according to an embodiment of the invention (when a pressing unit is released).
Figure 9B:
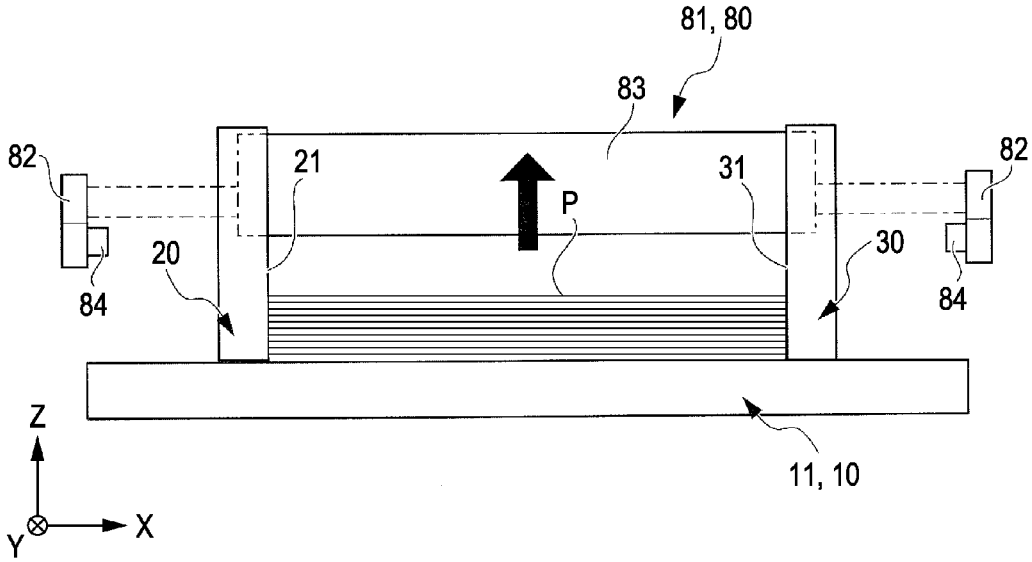

FIGS. 9A and 9B are schematic diagrams illustrating a feeding unit when a recording paper press-releasing operation is performed, in which FIG. 9A is a side view, and FIG. 9B is a diagram when seen from the upstream side in the feeding direction.

As shown in FIG. 9A, if the feeding motor 77 is reversely driven from the state in FIG. 7, the slide section 102 slides in the Y-axial arrow direction. Further, since the pressing unit 103 moves close to and comes in contact with the engaging lever 41, the engaging lever 41 swings in the counterclockwise direction in the figure while overcoming the biasing force of the spring 48.

Thus, the engaging lever 41 is swung in the counterclockwise direction, and thus, the engaging protrusion section 43 can be moved in a direction spaced from the second flat section 86. Then, a rear side of the engaging protrusion section 43 can come in contact with the first flat section 87 of the guide section 85.

Subsequently, the pressing section 103 further swings the engaging lever 41 in the counterclockwise direction. Then, the engaging protrusion section 43 swings the pressing lever 81 in the counterclockwise direction against the weight thereof while pressing the first flat section 87 upward in the stacking direction.

As a result, the paper contact section 83 can be moved upward in the stacking direction which is the direction distant from the surface of the recording paper P. That is, the paper contact section 83 can be released.

At this time, the engaging protrusion section 43 moves in a direction close to the first support shaft 84 while being in contact with the first flat section 87 in the guide section 85. That is, the engaging protrusion section 43 moves toward the center of the pressing arm section 82.

Further, the engaging lever 41 has the posture shown in FIGS. 3 and 5A. Thus, the posture of the pressing lever 81 has the posture as shown in FIGS. 3 and 5A.

At this time, the fifth gear 96 as shown in FIG. 4 reversely rotates, and thus, the first convex section (not shown) is spaced from the second convex section (not shown) and is engaged from the opposite side thereof. Further, the fifth gear 96 reversely rotates integrally with the ring section 121. Then, the third convex section (not shown) is spaced from the fourth convex section (not shown) and moves close thereto from the opposite side thereof. In this respect, before the third convex section (not shown) moves close to the fourth convex section (not shown) and is engaged with the fourth convex section (not shown) from the opposite side thereof, the controller 2 stops the feeding motor 77. If the third convex section (not shown) is engaged with the fourth convex section (not shown) from the opposite side thereof, the power transmission shaft 110 reversely rotates, and thus, the first edge guide 20 and the second edge guide 30 are opened outward in the width direction.

In the state where the opposite side edges of the recording paper P are aligned by the first edge guide 20 and the second edge guide 30, the carriage 61 is spaced from the contact lever (not shown). Thus, the power transmission of the power transmission mechanism 90 which transmits the power from the feeding motor 77 to the first edge guide 20, the second edge guide 30 and the pressing lever 81 can be in a cutoff state.

Thereafter, the controller 2 drives the feeding motor 77 to rotate the feeding roller 74. Further, the controller 2 swings the hopper lever 72 to move the hopper 71 to be close to the feeding roller 74, which is a so-called hopper up operation. Thus, among the plurality of recording papers P which are stacked on the paper stacking section 11, the uppermost recording paper P is fed toward a downstream side in the feeding direction by the feeding roller 74. Then, recording is performed in the recording section 60.

At this time, since the pressing lever 81 is withdrawn upward in the stacking direction, there is no risk that the pressing lever 81 becomes a transport load with respect to the recording paper P. That is, a back tension does not occur while the recording is performed.

Further, the posture of the recording paper P is stabilized by the first edge guide 20 and the second edge guide 30.

As a result, a desired recording can be performed.

Moreover, the power transmission mechanism 90 includes the worm 111, the first helical rack 22 and the second helical rack 32. Thus, a rotation having a large speed reduction ratio can be transmitted. In this respect, due to the large speed reduction ratio, torque of the worm 111 can be easily converted into a force for moving the first edge guide 20 and the second edge guide 30 in the width direction X. Contrarily, the force for moving the first edge guide 20 and the second edge guide 30 in the width direction X can be made to be difficult to convert into a force for rotating the worm 111.

That is, the side edges of the recording paper P are in contact with the first edge guide 20 and the second edge guide 30 during feeding, and thus, even though the first edge guide 20 and the second edge guide 30 are pressed outward in the width direction, the first edge guide 20 and the second edge guide 30 are hardly opened outward in the width direction. As a result, the posture of the recording paper P during feeding can be stabilized.

In this embodiment, the engaging lever 41 is configured to be swung by the lever swing unit 100 and the biasing force of the spring 48, but this is not limitative. The slide section 102 and the engaging lever 41 are completely connected to each other, and the engaging lever 41 may be swung without using the spring 48.

Further, when the feeding motor 77 is reversely driven, right after the third convex section (not shown) moves close to the fourth convex section (not shown) from the opposite side thereof and is engaged with the fourth convex section (not shown), the feeding motor 77 may be stopped. In this case, by slightly moving the first edge guide 20 and the second edge guide 30 outward in the width direction, a frictional resistance generated due to the contact of the first edge guide 20 and the second edge guide 30 with respect to the opposite side edges of the recording paper P can be reduced. As a result, the back tension can be further reduced.

Further, in a case where recording is performed by feeding the recording paper P continuously in one job, feeding can be continuously performed in a state as shown in FIGS. 9A and 9B.

Here, the "one job" refers to one input command. For example, if a command for feeding ten recording papers P for recording is input, the process of feeding ten recording papers P and performing recording becomes the one job.

Until the number of the remaining recording paper P which is stacked on the paper stacking section 11 reaches 0, or until setting conditions such as size and type of the recording paper P are changed, the feeding can be continuously performed in a state as shown in FIGS. 9A and 9B.

Before the recording paper P is fed sheet by sheet, the first edge guide 20 and the second edge guide 30 are closed inward in the width direction, and then, the presence or absence of the recording paper P can be recognized. In this case, the hopper-up operation can be prevented in a state where the recording paper P is not present. As a result, damage of the feeding roller 74 due to a direct collision of the feeding roller 74 and the hopper 71 can be prevented from being generated.

Figures 10, 10A:
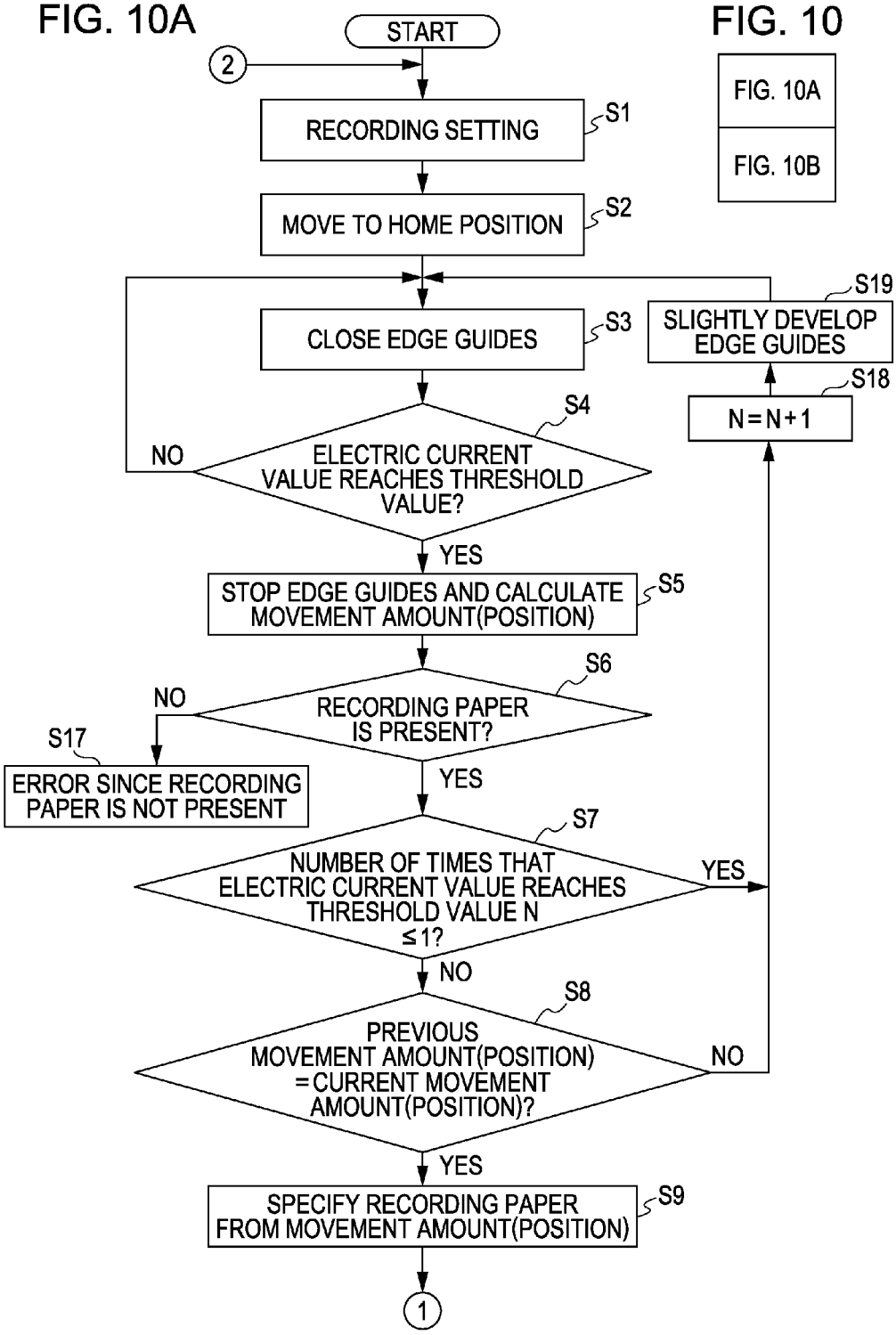
FIG. 10, including
FIGS. 10A and 10B, is a chart illustrating an operation of edge guides according to an embodiment of the invention.
Figure 10B:
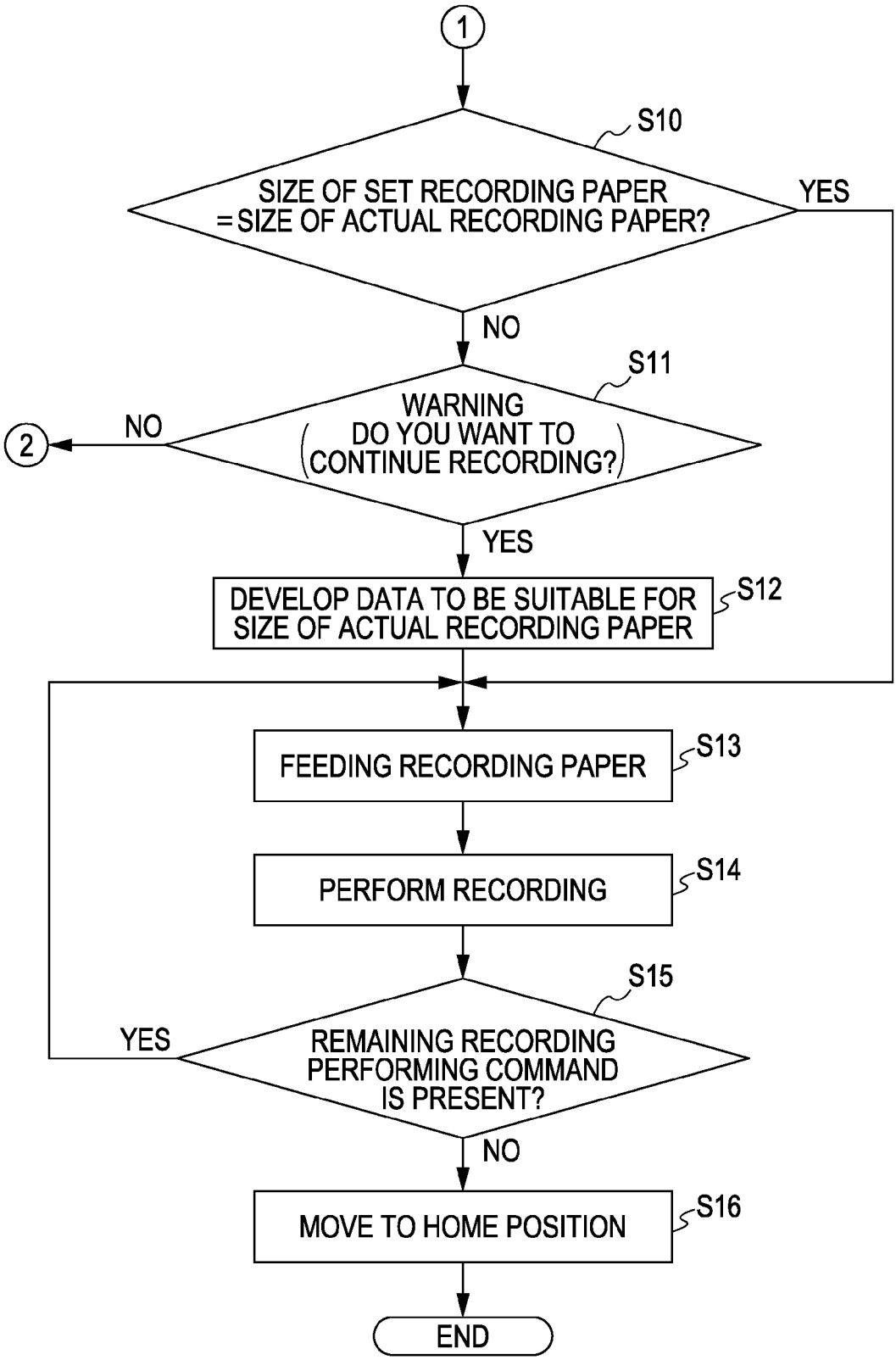

FIG. 10 is a chart illustrating an operation of edge guides according to an embodiment of the invention.

As shown in FIG. 10, in step S1, a user performs a recording setting. Specifically, the user powers on the recording apparatus 1. Further, the user selects image data of images such as a photograph to be recorded. Then, the user selects settings such as a recording paper size, type, image quality mode, borderless recording mode, etc. In addition, the user confirms the selection by viewing a print preview which is displayed on a display or a screen of a personal computer. Thereafter, the procedure goes to step S2.

In step S2, the controller 2 moves the edge guides 20 and 30 to a home position (see FIG. 3). Here, the "home position" refers to a position of a state where the edge guides 20 and 30 are fully opened outward in the width direction in a movable range, so that the controller 2 can confirm the position of the edge guides 20 and 30, and the user can set the recording paper P.

Specifically, the first edge guide 20 and the second edge guide 30 are moved up to the home position (position as shown in FIGS. 4 and 5) which is the outermost position in the movable range in the width direction X. At this time, the first edge guide 20 and the second edge guide 30 are installed to be in contact with a regulating section (not shown). Then, the procedure goes to step S3.

At this time, a load measurement may be performed. The controller 2 measures an electric current value of the feeding motor 77 which is the DC motor as the load at the time when the first edge guide 20 and the second edge guide 30 are moved. At this time, the first edge guide 20 and the second edge guide 30 move up to the innermost position in the movable range from the home position, and then move up to the original home position.

Here, as the measurement is performed, the "predetermined threshold value" which will be described can be changed.

In step S3, the controller 2 moves down the pressing lever 81 (see FIG. 6). Then, the controller 2 moves the first edge guide 20 and the second edge guide 30 inward in the width direction (see FIG. 7), so as to confirm the presence or absence of the recording paper P, and to determine the size of the recording paper P.

At this time, as described above, the carriage 61 moves toward a downstream side in the X-axial arrow direction in the width direction X, and the power transmission of the power transmission mechanism 90 is connected. Accordingly, as the feeding motor 77 is driven, the first edge guide 20 and the second edge guide 30 can be moved inward in the width direction. Then, the procedure goes to step S4.

In step S4, a determining section of the controller 2 determines whether the electric current value of the feeding motor 77 reaches the predetermined threshold value, so as to determine whether the first edge guide 20 and the second edge guide 30 are in contact with the opposite edges of the recording paper P.

Here, as described above, the "predetermined threshold value" is the value larger than the electric current value due to the load at the time when the first edge guide 20 and the second edge guide 30 are only in contact with one side edge of the recording paper P. Further, the predetermined threshold value is the value smaller than the electric current value due to the load at the time when the first edge guide 20 and the second edge guide 30 are in contact with the opposite side edges of the recording paper P of which the opposite side edges are aligned.

In this embodiment, the predetermined threshold value is set as the electric current value, but the predetermined threshold value may be set as a voltage value. In this case, the same effect can also be obtained.

Further, in the case where it is determined that the electric current value reaches the predetermined threshold value, the procedure goes to step S5, so as to determine that the first edge guide 20 and the second edge guide 30 come in contact with the opposite side edges of the recording paper P of which the opposite side edges are aligned, to thereby stop the movement of the edge guides 20 and 30. On the other hand, in the case where it is determined that the electric current value does not reach the predetermined threshold value, the procedure returns to step S3. This is because the side edges of the recording paper P are not yet aligned, and the edge guides 20 and 30 need to further move to align the side edges of the recording paper P.

In step S5, the controller 2 stops the movement of the edge guides 20 and 30. Further, the movement amount of the edge guides 20 and 30 is obtained. Specifically, the driving of the feeding motor 77 is stopped. In addition, the movement amount of the edge guides 20 and 30 from the home position which is the reference to a stop position is calculated by means of the rotary encoder 3 and the encoder sensor 4 which are installed in the proximity of the feeding motor 77.

Here, in consideration of the driving amount of the feeding motor 77 which has not been transmitted to the edge guides 20 and 30 by means of the time lag mechanism 120, the movement amount of the edge guides 20 and 30 can be calculated.

Further, since the movement amount of the edge guides 20 and 30 can be calculated by means of the rotary encoder 3 and the encoder sensor 4, it is not necessary to install an exclusive linear encoder scale for detecting only the position and the movement amount of the edge guides 20 and 30 in the edge guides 20 and 30 or the base 10. That is, the movement amount of the edge guides 20 and 30 can be calculated by means of the rotary encoder 3 and the encoder sensor 4 for detecting the driving amount of the feeding motor 77. Further, the position may be calculated on the basis of the movement amount. Then, the procedure goes to step S6.

In step S6, the controller 2 determines the presence or absence of the recording paper P on the paper stacking section. Specifically, the controller 2 compares the movement amount of the edge guides 20 and 30 which is calculated in step S5 with a distance between the home position and a position of the edge guides 20 and 30 corresponding to a recording paper P' having a minimum stackable size (see FIGS. 7 and 8).

Here, the "recording paper having the minimum stackable size" refers to the recording paper P' having the minimum size among sizes of the recording paper which can be handled by the recording apparatus 1.

Further, in the width direction X, the innermost position in the movable range of the edge guides 20 and 30 is located inward in the width direction with respect to the position of the edge guides 20 and 30 corresponding to the recording paper P' having the minimum size which can be handled by the recording apparatus 1.

Further, in the case where it is determined that the movement amount of the edge guides 20 and 30 which is calculated in step S5 is larger than the distance (movement amount), the controller 2 determines that the recording paper P (P') is not present (see FIG. 8). In this case, errors occur, and thus, the procedure goes to step S17.

On the other hand, in the case where it is determined that the movement amount of the edge guides 20 and 30 which is calculated in step S5 is equal to or smaller than the distance (movement amount), the controller 2 determines that the recording paper P is present (see FIG. 7). In this case, the recording can be performed, and thus, the procedure goes to step S7.

In step S7, the controller 2 determines whether a value of a counter which counts the number of times of the determination that the electric current value reaches the threshold value in step S4 reaches a predetermined number of times (once in this embodiment), so as to enable the edge guides 20 and 30 to come in contact with the opposite side edges of the recording paper P a plurality of times. As the edge guides 20 and 30 come in contact with the opposite side edges of the recording paper P the plurality of times, the opposite side edges of the recording paper P can be aligned in a tidier manner, compared with the case that the edge guides 20 and 30 come in contact with the opposite side edges of the recording paper P only one time.

In this embodiment, the number of predetermined times is 1, but may be an integer of 2 or more. If the number of predetermined times is 2, in step S7, the controller 2 determines whether the number of times of the determination that the electric current value reaches the threshold value in step S4 reaches two times.

In addition, if it is determined that the number of times of the determination reaches two times, the procedure goes to step S8 so as to determine an alignment state of the side edges of the recording paper P. On the other hand, if it is determined that the number of times of the determination is not reached two times yet, the procedure goes to step S18 so as to repeat the above process until the number of times of the determination reaches two times.

In step S8, the controller 2 determines whether the previous movement amount of the edge guides 20 and 30 is the same as the current movement amount of the edge guides 20 and 30.

In this respect, the "same" represents approximately the same in a specific width range in which errors are considered. In other words, the controller 2 determines whether a difference between the previous movement amount and the current movement amount is equal to or smaller than a predetermined allowable value.

In the case where it is determined that the difference is equal to or smaller than the predetermined allowable value, the controller 2 can determine that the side edges of the recording paper P have already been aligned in a tidy manner. On the other hand, in a case where it is determined that the difference is not equal to or smaller than the predetermined allowable value, the controller 2 can determine that the side edges of the recording paper P are gradually aligned but are still in a scattered state.

Here, the current movement amount of the edge guides 20 and 30 is a movement amount in the n-th (n is a plural number) operation in which the edge guides 20 and 30 are closed inward in the width direction calculated in step S5. On the other hand, the previous movement amount of the edge guides 20 and 30 is a movement amount in an operation (step S19 to be described later) in which the edge guides 20 and 30 are opened right before the operation in which the edge guides 20 and 30 are closed inward in the width direction.

In addition, in a case where the plural number n is an integer of 3 or more, the previous movement amount of the edge guides 20 and 30 may be a movement amount in the m-th operation in which the edge guides 20 and 30 are closed inward in the width direction, in which m is a plural number smaller than the plural number n by 1.

Further, instead of the movement amount, the determination may be performed on the basis of the position of the edge guides 20 and 30. Specifically, the controller 2 may determine whether the position of the edge guides 20 and 30 at the previous closed time is the same as the position of the edge guides 20 and 30 at the current closed time. In this case, the controller 2 may also determine whether both the positions are approximately the same in a specific width range in which errors are considered. The position of the edge guides 20 and 30 can be calculated on the basis of the movement amount of the edge guides 20 and 30 which is calculated by the rotary encoder 3 and the encoder sensor 4.

Further, in a case where it is determined that both the positions are the same (a case where it is determined that a difference between both the positions is equal to or smaller than a predetermined allowable value), it is determined that the side edges of the recording paper P are aligned in a tidy manner, and then, the procedure goes to step S9 so as to specify the size of the recording paper P. On the other hand, in a case where it is determined that both the positions are not the same (a case where it is determined that the difference between both the positions is not equal to or smaller than a predetermined allowable value), it is determined that the side edges of the recording paper P are not yet sufficiently aligned, and then, the procedure goes to step S18 so as to repeat the above process until the alignment is completed.

In step S9, the controller 2 sets the feeding motor 77 in a hold state. Further, the controller 2 specifies the width of the recording paper on the basis of the movement amount of the edge guides 20 and 30. Specifically, the controller 2 applies an imperceptible electric current to the feeding motor 77 so that the motor pinion 91 does not move and is in the hold state. Moreover, the position of the current edge guides 20 and 30 is calculated on the basis of the movement amount of the edge guide 20 and 30 which is calculated by means of the rotary encoder 3 and the encoder sensor 4. Thus, the controller 2 specifies the width of the recording paper. That is, the controller 2 determines which size of the recording paper P is set. Then, the procedure goes to step S10 so as to determine whether the size of the recording paper P which is determined by the controller 2 is the same as the size of the recording paper P which is intended by the user.

In step S10, the controller 2 determines whether the size of the recording paper which is already set is the same as the size of the recording paper which is actually set. Specifically, the controller 2 determines whether the size of the recording paper which is set by the user through a user interface which is an input section in step S1 is the same as the size of the recording paper which is specified in step S9.

Here, the "same" represents approximately the same in a specific width range in which errors are considered.

In a case where it is determined that both the sizes are the same, the procedure goes to step S13 so as to directly feed the recording paper P to then start recording. On the other hand, in a case where it is determined that both the sizes are not the same, the procedure goes to step S11 so as to request the user to confirm the recording paper.

In step S11, the controller 2 displays a warning on the display unit or the personal computer screen.

Specifically, "The set recording paper is different. Do you want to continue recording (printing)?" is displayed, to thereby request the user to confirm the recording paper.

In addition, a warning sound may be output.

Further, in a case where the user performs a manipulation for the recording in the current state, that is, in a case where the user presses an OK (Yes) button or the like, the procedure goes to step S12 so that the recording range of recording image data is suitable for the size of the actual recording paper.

Here, the "recording image data" represents data for ejection of ink from the recording head 62.

On the other hand, in a case where the user performs a manipulation against the recording in the current state, that is, in a case where the user presses a No button or the like, the sequence is stopped. In this case, the edge guides 20 and 30 move to the home position outward in the width direction. Accordingly, the user can change the size of the recording paper. Further, in a case where the user changes the size of the recording paper, the procedure returns to step S1.

In step S12, the controller 2 develops image data D1 (see FIG. 11) of images into recording image data D3 (see FIG. 11) to be suitable for the size of the recording paper. That is, the image data D1 is enlarged or reduced to be suitable for the size of the actual recording paper to be developed into the recording image data D3.

Here, the "image data" represents data of images input to the recording apparatus 1, which is data in a state before being developed (converted) into the recording image data D3 (D2) for performing recording.

In addition, in a stage before the controller 2 determines that both the sizes are "not the same" in step S10, in a case where the controller 2 has already developed the image data D1 of the image into the recording image data D2, the controller 2 develops the original image data D1 into the recording image data D3 to be suitable for the size of the actual recording paper. Alternately, the controller 2 may develop the recording image data D2 (see FIG. 11) which is not suitable for the size of the recording paper which is developed once into the recording image data D3 again which is suitable for the size of the recording paper. In this case, the recording image data D2 which is not suitable for the size of the recording paper may return to the original image data D1 and then may be developed again into the recording image data D3 which is suitable for the size of the recording paper, or may be directly developed into the recording image data D3 which is suitable for the size of the recording paper.

For example, it is assumed that the size of the actual recording paper is a king size P1 (102 mm long (length of the width direction X)×152 mm wide (length of the feeding direction Y)) (see FIG. 11). In this respect, it is assumed that the image data D1 corresponds to an L size (89 mm long (length of the width direction X)×127 mm (length of the feeding direction Y)). In this case, the controller 2 develops the image data D1 of the image into the recording image data D3 to correspond to the king size. That is, the image data D1 is enlarged into the king size.

At this time, in the case of the so-called borderless recording mode, the controller 2 performs development in a similar way so that recording can be performed in the borderless recording mode.

Alternatively, it is assumed that the size of the actual recording paper is the L size P2 (89 mm long (length of the width direction X)×127 mm (length of the feeding direction Y)) (see FIG. 11). In this respect, it is assumed that the image data D1 of the image corresponds to the king size (102 mm long (length of the width direction X)×152 mm wide (length of the feeding direction Y)). In this case, the controller 2 develops the image data D1 of the image into the recording image data D3 to correspond to the L size. That is, the image data D1 is reduced into the L size.

Further, the procedure goes to step S13 so as to feed the recording paper P.

In step S13, the controller 2 starts the feeding of the recording paper P. Specifically, the controller 2 drives the feeding motor 77 and moves the hopper 71 to be close to the feeding roller 74. Then, the controller 2 drives the feeding roller 74. Further, the feeding roller 74 picks up the recording paper which is located on the top with respect to the feeding roller 74 among the recording papers P which are stacked on the paper stacking section 11, and feeds the picked up recording paper to the recording section 60 which is installed on a downstream side in the feeding direction. At this time, as described above, the pressing lever 81 may move upward (see FIG. 9). Further, in order to reduce the back tension, the edge guides 20 and 30 may slightly move outward in the width direction. Further, the procedure goes to step S14 so as to perform recording.

In step S14, the controller 2 performs the recording with respect to the recording paper P. Specifically, the transport driving roller 51 and the transport driven roller 52 transport the recording paper P which has been fed by the feeding roller 74 to the recording section 60. In addition, the controller 2 enables ink to be ejected from the recording head 62 while feeding the recording paper P to perform the recording. At this time, in the case where it is determined that both the sizes are the same in step S10, the controller 2 performs the recording on the basis of the recording image data D2 (D3) in a state where the recording range is not changed.

Here, the "recording image data" represents data for ejection of ink from the recording head 62 as described above.

Further, the recording image data D2 (D3) may be developed in advance from the image data D1 for preparation before the recording starts. The developing method uses a data developing method which is a known technology (for example, JP-A-2002-118757). According to the developing method, the image data D1 of the image is converted into the recording image data D2 (D3) through alignment conversion or the like. The alignment conversion is needed since an alignment order of the data for ejection of ink from a nozzle array direction of respective colors of the recording head 62 is different from an alignment order of respective colors of the image data D1.

Further, the alignment conversion is needed to convert the data to correspond to the ink colors. For example, in a case where the image data D1 of the image is an RGB type of three primary colors (Red, Green and Blue), the RGB type is converted into a CMYK type in which black is added to three primary colors of cyan, magenta and yellow, to thereby obtain the recording image data D2 (D3). In a case where there are more ink colors than the four colors of CMYK, conversion may be performed according to the colors.

On the other hand, in the case where it is determined that both the sizes are not the same in step S10, recording is performed on the basis of the recording image data D3 which is developed in step S12. In this case, a changing process of the recording image data in a recording range can start from a stage before starting feeding. Further, the changing process of the recording image data in the recording range can be completed before starting recording. That is, there is no risk that the transport driving roller 51 is stopped and the recording starting is delayed since the changing process of the recording image data in the recording range is not completed.

Accordingly, there is no risk that a so-called throughput which is time required for every sheet from the feeding starting to the recording completion is lengthened.

After the recording completion, the recording paper P is discharged. Further, the procedure goes to step S15 so as to determine whether the remaining recording performing command is present.

Here, the "remaining recording performing command" is a recording performing command with respect to the next recording paper P in one job. The "one job" is a series of input commands. For example, if a command for feeding ten recording papers P for recording is input, the process of feeding ten recording papers P and performing recording becomes the one job.

In step S15, the controller 2 determines whether the remaining recording performing command is present. In a case where the remaining recording performing command is present, the controller 2 continuously performs feeding and recording. In a case where it is determined that the remaining recording performing command is present, the procedure returns to step S13 so as to continuously perform feeding and recording. On the other hand, in a case where it is determined that the remaining recording performing command is not present, the procedure goes to step S16 so as to terminate the sequence.

In step S16, the controller 2 moves the edge guides 20 and 30 to the home position. As the edge guides 20 and 30 are moved to the home position which becomes the reference, it is possible to rapidly meet the change of the size of the recording paper or the next job. Specifically, the controller 2 moves the edge guides 20 and 30 outward in the width direction by driving the feeding motor 77. Then, the sequence terminates.

In step S17, the controller 2 processes the current state as an error since it is determined that the recording paper P is not present on the paper stacking section 11.

In step S18, the controller 2 sets the value of the counter as N=N+1 so as to increase the number of times that the electric current value reaches the threshold value. Further, the procedure goes to step S19 so as to slightly move the edge guides 20 and 30 outward in the width direction.

In step S19, the controller 2 slightly moves the edge guides 20 and 30 outward in the width direction. In other words, the controller 2 slightly opens the edge guides 20 and 30 outward in the width direction. Thus, the edge guides 20 and 30 can be spaced from the side edges of the recording paper P, and the edge guides 20 and 30 can strike the side edges of the recording paper P when the edge guides 20 and 30 are closed inward in the width direction in steps S3 and S4.

At this time, the controller 2 stores the movement amount of the edge guides 20 and 30 outward in the width direction, so that the controller 2 can determine in step S8 whether the difference between the movement amounts (positions) is equal to or smaller than the allowable value.

By sequentially looping steps S3 to S8, step S18 and step S19, when the opposite side edges of the recording paper P are aligned, the edge guides 20 and 30 can strike the opposite side edges of the recording paper P a plurality of times. Thus, the opposite side edges of the recording paper P can be aligned in a tidier manner with higher accuracy, compared with the case where the edge guides 20 and 30 strike the side edges of the recording paper P only one time.

Further, it is possible to generate a gap between the recording paper P and the recording paper P by the strikes of the plurality of times. Accordingly, it is possible to align the opposite side edges while loosening a bundle of the stacked recording papers P. That is, by loosening the recording paper P and the recording paper P which cling to each other, the opposite side edges of the recording papers P can be aligned with high accuracy. As a result, the determination of the size of the recording paper P can be performed with higher accuracy.

Moreover, in this embodiment, the edge guides 20 and 30 use a so-called center alignment type where the first edge guide 20 and the second edge guide 30 move in a bilaterally symmetric way, but are not limited thereto. That is, a so-called one side alignment type may be used where one of the edge guides is fixed and only the other one of the edge guides is moved.

Figure 11A:
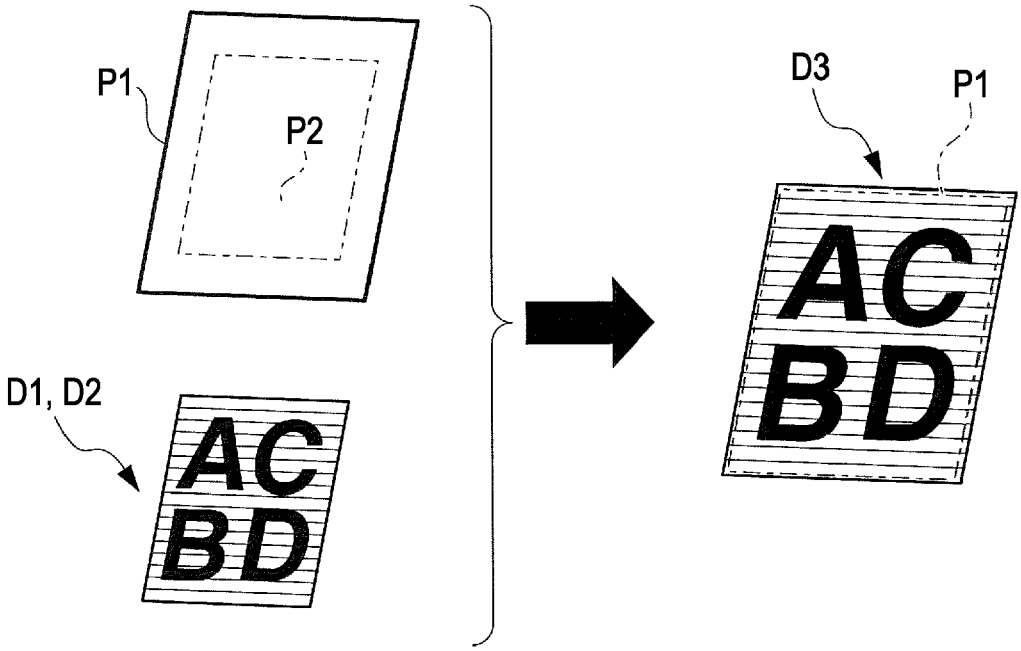
FIGS. 11A and 11B are diagrams illustrating an example of an image development according to an embodiment of the invention.
Figure 11B:
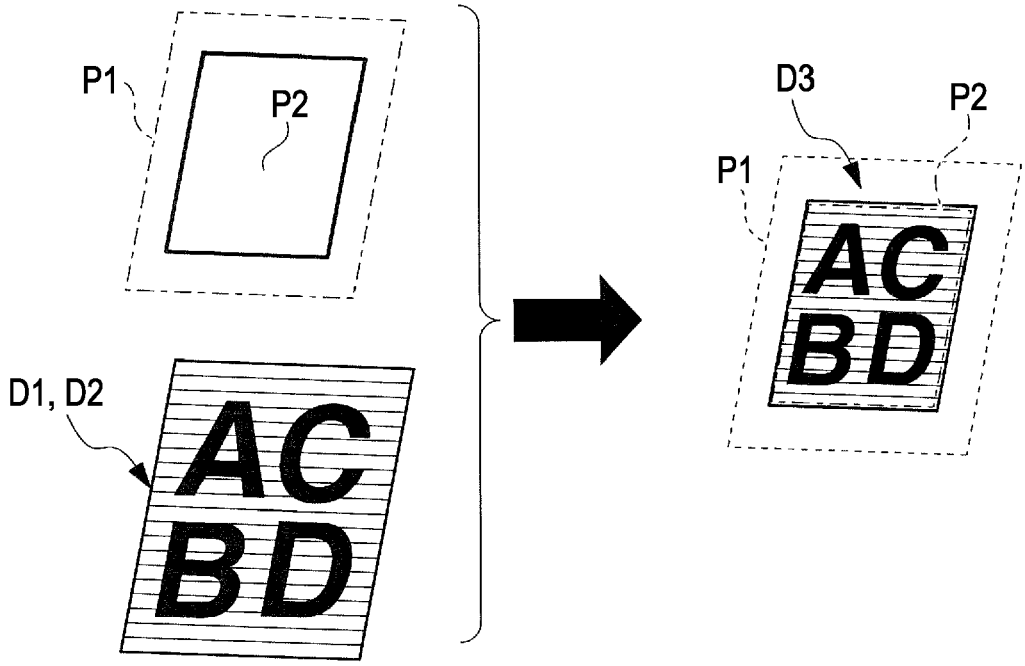

FIGS. 11A and 11B are diagrams illustrating an example of the image development in step S12 according to an embodiment of the invention. Here, FIG. 11A is a concept diagram illustrating an example of the case where the size of the actual recording paper is the king size and the image data of the image corresponds to the L size; and FIG. 11B is a concept diagram illustrating an example of the case where the size of the actual recording paper is the L size and the image data of the image corresponds to the king size.

As shown in FIG. 11A, for example, it is assumed that the size of the actual recording paper is the king size P1 (102 mm long (length of the width direction X)×152 mm wide (length of the feeding direction Y)). In this respect, it is assumed that the image data D1 of the image (or the recording image data D2 which is not suitable for the size of the recording paper which are developed one time) corresponds to the L size (89 mm long (length of the width direction X)×127 mm (length of the feeding direction Y)).

In this case, the controller 2 develops the image data D1 (or the recording image data D2 which is not suitable for the size of the recording paper which is developed one time) into the recording image data D3 to correspond to the king size. That is, the image data D1 is enlarged into the king size.

At this time, in the case of the so-called borderless recording mode, the controller 2 performs development in a similar way so that recording can be performed in the borderless recording mode.

As shown in FIG. 11B, for example, it is assumed that the size of the actual recording paper is the L size P2 (89 mm long (length of the width direction X)×127 mm wide (length of the feeding direction Y)). In this respect, it is assumed that the image data D1 of the image (or the recording image data D2 which is not suitable for the size of the recording paper which is developed one time) corresponds to the king size (102 mm long (length of the width direction X)×152 mm wide (length of the feeding direction Y)).

In this case, the controller 2 develops the image data D1 (or recording image data D2 which is not suitable for the size of the recording paper which is developed one time) into the recording image data D3 to correspond to the L size. That is, the image data D1 is reduced to the L size.

The recording apparatus 1 in this embodiment includes the paper stacking section 11 which is the stacking section on which the recording paper P, which is an example of the recording target medium, is stacked; the first edge guide 20 and the second edge guide 30 which are the edge guides which can move the recording paper P in the width direction X and align the side edges of the recording paper P stacked on the paper stacking section 11; the feeding motor 77 which is the motor which moves the first edge guide 20 and the second edge guide 30; the controller 2 which is the determining section which determines whether the electric current value at the time when the feeding motor 77 is driven reaches the predetermined threshold value; and the position detecting section 5 which detects the position of the first edge guide 20 and the second edge guide 30 in the width direction X. Here, when the side edges of the recording paper P are aligned, the controller 2 moves the first edge guide 20 and the second edge guide 30 to be close to the recording paper P by the power of the feeding motor 77 while monitoring the electric current value (step S3), stores (steps S5 and S19) the position of the first edge guide 20 and the second edge guide 30 at the time (step S4) when the electric current value reaches the predetermined threshold value, moves the first edge guide 20 and the second edge guide 30 to be spaced from the recording paper P by the power of the feeding motor 77 (step S19), and then moves the first edge guide 20 and the second edge guide 30 to be close to the recording paper P while monitoring the electric current value (step S3). Then, the controller 2 determines (step S8) whether the difference between the position (step S5 at the current time) of the first edge guide 20 and the second edge guide 30 at the time (step S4 at the current time) when the electric current value reaches the predetermined threshold value and the stored position (step S5 at the previous time) of the first edge guide 20 and the second edge guide 30 is equal to or smaller than the predetermined allowable value. If it is determined that the difference between both the positions is not equal to or smaller than the predetermined allowable value, the controller 2 moves the first edge guide 20 and the second edge guide 30 to be spaced from the recording paper P by the power of the feeding motor 77 (step S19), and then moves the first edge guide 20 and the second edge guide 30 to be close to the recording paper P until the electric current value reaches the predetermined threshold value while monitoring the electric current value (step S3).

Further, in this embodiment, when the side edges of the recording paper P are aligned, the controller 2 moves the first edge guide 20 and the second edge guide 30 to be close to the recording paper P in the movable range of the first edge guide 20 and the second edge guide 30 (step S3), and enables the first edge guide 20 and the second edge guide 30 to come in contact with the edge sides of the recording paper P a plurality of times in the case where the electric current value reaches the predetermined threshold value in the position which does not exceed the position corresponding to the recording paper P' having the usable minimum size (steps S3 to S7, steps 18 and S19), and then moves the first edge guide 20 and the second edge guide 30 to be spaced from the recording paper P (P') in the case where the electric current value reaches the predetermined threshold value in the position which exceeds the position corresponding to the recording paper P' having the usable minimum size and stops the first edge guide 20 and the second edge guide 30 (step S17).

Moreover, in this embodiment, the recording apparatus 1 further includes the transport unit 50 or the feeding unit 70 which is transporting tools which transports the recording paper P to the recording section 60 which is installed on the downstream side in the feeding direction from the paper stacking section 11, and the rotary encoder 3 and the encoder sensor 4 which is a sensor for measuring the amount of the recording paper P transported by the transport unit 50 or the feeding unit 70. The motor serves as the feeding motor 77 which drives the transport unit 50 or the feeding unit 70. The position detecting section 5 performs detection by means of the encoder sensor 4 and the rotary encoder 3.

First Other Embodiment

Figure 12:
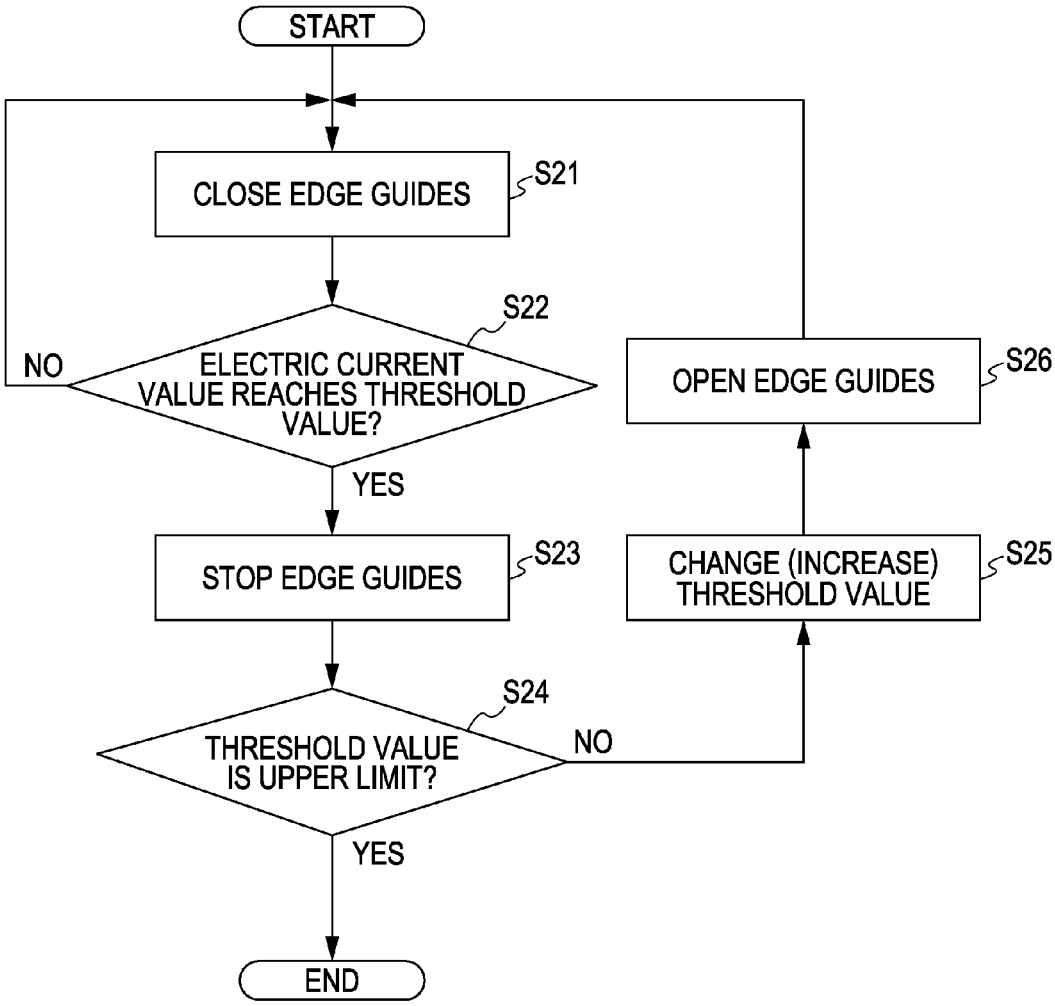
FIG. 12 is a chart illustrating an operation of edge guides according to another embodiment of the invention.

FIG. 12 is a chart illustrating an operation of edge guides according to a first other embodiment of the invention.

As shown in FIG. 12, the threshold value, at the time when the edge guides 20 and 30 move close to the recording paper P and come in contact with the side edges of the recording paper P a plurality of times, is gradually increased. Specifically, steps S21 to S26 in the first other embodiment are performed in place of steps S3 to S7 and steps S17 to S19 in the above described embodiment (see FIG. 10), which will be described in detail.

Here, respective members are the same as in the above described embodiment and are given the same reference numerals, description of which will be omitted.

In step S21, in a similar way to step S3 in the above described embodiment, the controller 2 moves down the pressing lever 81 (see FIG. 6). Then, the controller 2 moves the first edge guide 20 and the second edge guide 30 inward in the width direction (see FIG. 7), so as to confirm the presence or absence of the recording paper P and to determine the size of the recording paper. Then, the procedure goes to step S22.

In step S22, in a similar way to step S4 in the above described embodiment, the determining section of the controller 2 determines whether an electric current value of the feeding motor 77 reaches a predetermined threshold value which is set in a predetermined range, so as to determine whether the first edge guide 20 and the second edge guide 30 have come in contact with the opposite side edges of the recording paper P.

Here, the "threshold value which is set in the predetermined range" is a value larger than an electric current value due to the load at the time when the first edge guide 20 and the second edge guide 30 are individually in contact with only one side edge of the recording paper P, and is a value smaller than an electric current value due to the load at the time when the first edge guide 20 and the second edge guide 30 are in contact with opposite side edges of the recording paper P of which the opposite side edges are aligned.

When the operation of aligning the recording paper P starts, the threshold value is set to a relatively small value in the predetermined range. The threshold value is preferably set to the minimum value in the predetermined range. Thus, the edge guides 20 and 30 can smoothly come in contact with the side edges of the recording paper P, and the side edges of the recording paper P can be prevented from being bent. That is, among the side edges of the plurality of recording papers P which are not aligned, the edge guides 20 and 30 can smoothly come in contact with the side edge of one recording paper P which protrudes, to thereby slightly push in the side edge of the recording paper P without bending.

In the first other embodiment, the threshold value is set to the electric current value, but may be set to a voltage value. In this case, the same effect can be achieved.

Further, in a case where it is determined that the electric current value reaches the threshold value, the procedure goes to step S23, so as to stop the movement of the edge guides 20 and 30 by determining that the electric current value reaches the threshold value. On the other hand, in a case where it is determined that the electric current value does not reach the threshold value, the procedure returns to step S21. This is because the side edges of the recording paper P are not yet aligned, and thus, the edge guides 20 and 30 need to further move to align the side edges of the recording paper P.

In step S23, in a similar way to step S5 in the above described embodiment, the controller 2 stops the movement of the edge guides 20 and 30. Further, the procedure goes to step S24 so that the controller 2 determines whether a force for pressing the side edges of the recording paper P by the edge guides 20 and 30 is sufficiently strong.

In addition, in a similar way to the above described embodiment, the movement amount of the edge guides 20 and 30 may be obtained. Specifically, the driving of the feeding motor 77 is stopped. Further, the controller 2 calculates the movement amount of the edge guides 20 and 30 from the reference home position to the stopped position by means of the rotary encoder 3 and the encoder sensor 4 which are installed in the proximity of the feeding motor 77. Thus, the controller 2 can determine the presence or absence of the recording paper P. Further, in a case where it is determined that the recording paper is present, the size of the recording paper can be specified.

In step S24, the controller 2 determines whether the threshold value which is currently set is an upper limit in the predetermined range. As the force for pressing the side edges of the recording paper P by the edge guides 20 and 30 is set to the strongest value in the predetermined range, the side edges of the recording paper P can be firmly aligned in a tidy manner.

Further, in a case where it is determined that the threshold value which is currently set is the upper limit in the predetermined range, the edge guides 20 and 30 press the side edges of the recording paper P with a sufficiently strong force, and thus, the controller 2 can determine that the side edges of the recording paper P are aligned in a sufficiently tidy manner.

That is, since the recording paper P is damaged if the side edges of the recording paper P is pressed with a force stronger than the upper limit, the recording paper P is pressed with such a sufficiently strong force that the recording paper P may not be damaged, and thus, the controller 2 can determine that the recording paper P is aligned in a tidy manner to the maximum. Then, the sequence terminates.

Further, in this respect, the position of the edge guides 20 and 30 may be calculated to determine whether the side edges of the recording paper P are aligned in a sufficiently tidy manner.

On the other hand, in a case where it is determined that the threshold value which is currently set is not the upper limit in the predetermined range, the edge guides 20 and 30 may press the side edges of the recording paper P with a stronger force, and the controller 2 can determine that the side edges of the recording paper P are capable of being aligned more firmly. That is, the controller 2 can determine that there is room for aligning the side edges of the recording paper P in a tidier manner. Here, the procedure goes to step S25 for changing the setting of the threshold value to strengthen the force for pressing the side edges of the recording paper P by the edge guides 20 and 30.

Further, in this respect, the position of the edge guides 20 and 30 may be calculated to determine whether the side edges of the recording paper P are aligned in a sufficiently tidy manner.

In step S25, the controller 2 increases the threshold value which is currently set in the predetermined range. The degree of the increase may be set so that the threshold value after increase (after change) is in the predetermined range, but it is preferable that the increase is performed gradually little by little. Thus, the risk that the side edges of the recording paper P are bent can be reduced. Then, the procedure goes to step S26 for slightly moving the edge guides 20 and 30 outward in the width direction.

In step S26, in a similar way to step S19 in the above described embodiment, the controller 2 moves the edge guides 20 and 30 outward in the width direction little by little. In other words, the edge guides 20 and 30 are opened outward in the width direction little by little. Thus, the edge guides 20 and 30 are spaced from the side edges of the recording paper P, and then may strike the side edges of the recording paper P when the edge guides 20 and 30 are closed inward in the width direction once again in steps S21 and S22.

By sequentially looping steps S21 to S24, step S25 and step S26, when the opposite side edges of the recording paper P are aligned, the edge guides 20 and 30 may strike the opposite side edges of the recording paper P a plurality of times. Thus, the opposite side edges of the recording paper P can be aligned in a tidier manner with higher accuracy, compared with the case where the edge guides 20 and 30 strike the side edges of the recording paper P only one time.

Further, it is possible to set a force for pressing the side edges of the recording paper P by the edge guides 20 and 30 at the present time to be larger than a force for pressing the side edges of the recording paper P by the edge guides 20 and 30 at the previous time. As a result, the side edges of the recording paper P can be aligned gradually in a tidy manner without bending the side edges of the recording paper P.

Second Other Embodiment

Figure 13:
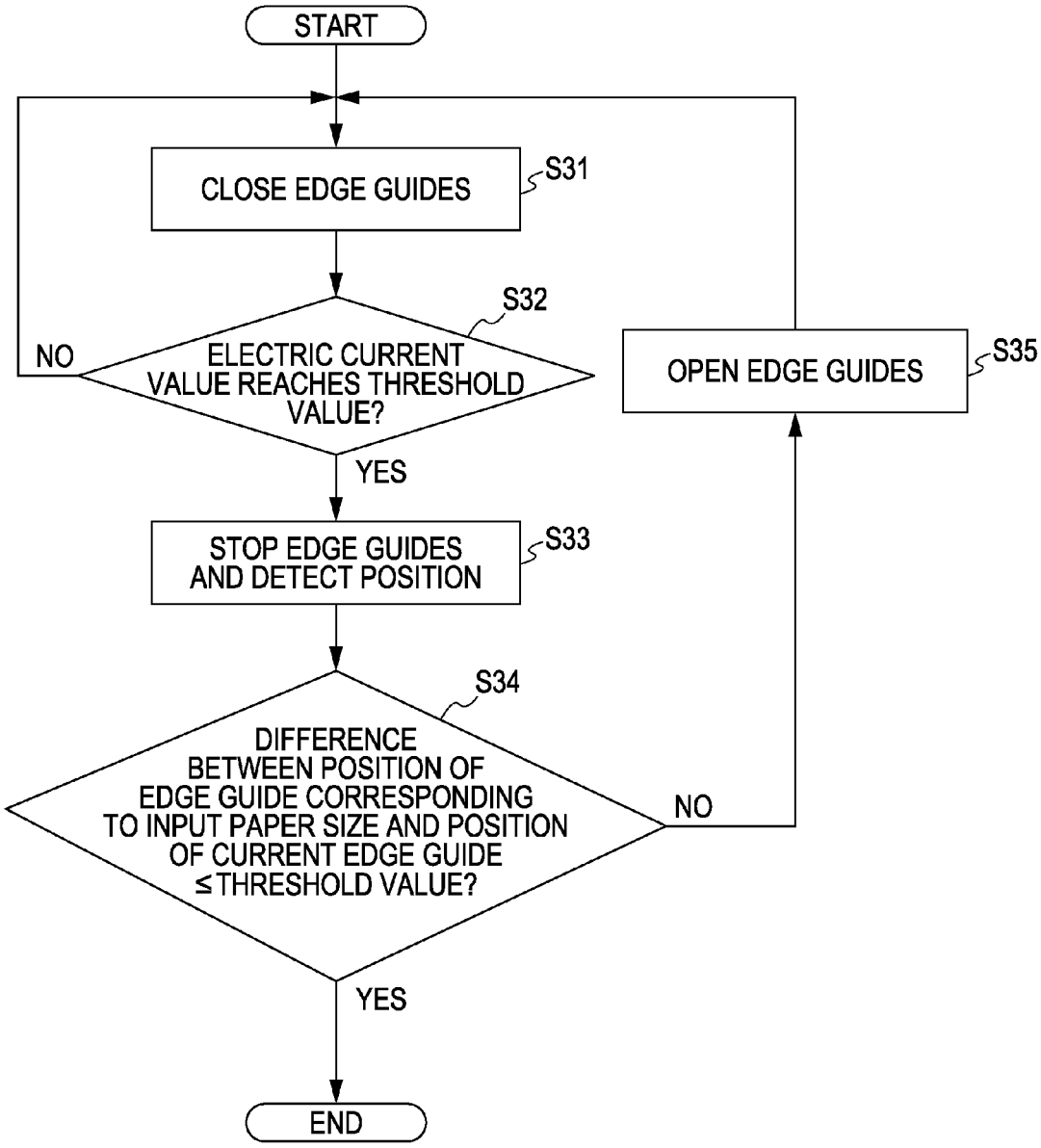
FIG. 13 is a chart illustrating an operation of edge guides according to still another embodiment of the invention.

FIG. 13 is a chart illustrating an operation of edge guides according to a second other embodiment of the invention.

As shown in FIG. 13, when the edge guides 20 and 30 move close to the recording paper P and come in contact with the side edges of the recording paper P a plurality of times, the threshold value is gradually increased. Specifically, steps S31 to S35 in the second other embodiment are performed in place of steps S3 to S7 and steps S17 to S19 in the above described embodiment (see FIG. 10), which will be described in detail.

Here, respective members are the same as in the above described embodiment and are given the same reference numerals, description of which will be omitted.

In step S31, in a similar way to step S3 in the above described embodiment, the controller 2 moves down the pressing lever 81 (see FIG. 6). Then, the controller 2 moves the first edge guide 20 and the second edge guide 30 inward in the width direction (see FIG. 7), so as to confirm the presence or absence of the recording paper P and to determine the size of the recording paper. Then, the procedure goes to step S32.

In step S32, in a similar way to step S4 in the above described embodiment, the determining section of the controller 2 determines whether an electric current value of the feeding motor 77 reaches a predetermined threshold value, so as to determine whether the first edge guide 20 and the second edge guide 30 have come in contact with the opposite side edges of the recording paper P.

In the second other embodiment, the threshold value is set to the electric current value, but may be set to a voltage value. In this case, the same effect can be achieved.

In a case where it is determined that the electric current value of the feeding motor 77 reaches the predetermined threshold value, the procedure goes to step S33, so as to stop the movement of the edge guides 20 and 30.

On the other hand, in a case where it is determined that the electric current value of the feeding motor 77 does not reach the predetermined threshold value, the procedure returns to step S31. This is because the side edges of the recording paper P are not yet aligned, and thus, the edge guides 20 and 30 need to further move to align the side edges of the recording paper P.

In step S33, in a similar way to step S5 of the above described embodiment, the controller 2 stops the movement of the edge guides 20 and 30, and then, obtains the movement amount of the edge guides 20 and 30. Specifically, the controller 2 stops the driving of the feeding motor 77. Then, the controller 2 calculates the movement amount of the edge guides 20 and 30 from the reference home position to the stopped position by means of the rotary encoder 3 and the encoder sensor 4 which are installed in the proximity of the feeding motor 77.

In this respect, the movement amount of the edge guides 20 and 30 can be calculated in consideration of the driving amount of the feeding motor 77 which has not been transmitted to the edge guides 20 and 30 by means of the time lag mechanism 120.

The current position of the edge guides 20 and 30 is calculated on the basis of the calculated movement amount. Then, the procedure goes to step S34 for determining whether the side edges of the recording paper P are aligned.

In step S34, the controller 2 determines whether a difference between a position of the edge guides 20 and 30 corresponding to input recording paper size information and the current position of the edge guides 20 and 30 is equal to or smaller than a predetermined allowable value.

In this respect, the "input recording paper size information" refers to information about the size of the recording paper P which is set by a so-called printer driver or the like. Specifically, the information includes information based on setting of the size of the recording paper P which is directly input to the recording apparatus 1 by a user, or information based on the setting of the size of the recording paper P which is transmitted from a personal computer.

In a case where it is determined that the difference between the position of the edge guides 20 and 30 corresponding to the input information about the size of the recording paper and the current position of the edge guides 20 and 30 is equal to or smaller than the predetermined allowable value, the controller 2 can determine that the side edges of the recording paper P are already aligned in a tidy manner. In this case, the sequence terminates.

On the other hand, in a case where it is determined that the difference between the position of the edge guides 20 and 30 corresponding to the input information about the size of the recording paper and the current position of the edge guides 20 and 30 is not equal to or smaller than the predetermined allowable value, the controller 2 can determine that the side edges of the recording paper P are still in a scattered state, that is, can determine that the side edges thereof are not aligned in a sufficiently tidy manner. Then, the procedure goes to step S35 for repeating the above process until the alignment is completed.

In step S35, in a similar way to step S19 in the above described embodiment, the controller 2 slightly moves the edge guides 20 and 30 outward in the width direction, that is, to be opened outward in the width direction slightly. Thus, the edge guides 20 and 30 move away from the side edges of the recording paper P and then strike the side edges of the recording paper P when the edge guides 20 and 30 are again closed inward in the width direction in steps S31 and S32.

As described above, according to the second other embodiment, when the opposite side edges of the recording paper P are aligned, in the case where the difference between the position of the edge guides 20 and 30 corresponding to the input recording paper size and the current position of the edge guides 20 and 30 is not equal to or smaller than the predetermined allowable value, the edge guides 20 and 30 can strike the opposite side edges of the recording paper P a plurality of times. Thus, the opposite side edges of the recording paper P can be aligned in a tidier manner with higher accuracy, compared with the case where the edge guides 20 and 30 strike the opposite side edges of the recording paper P only one time.

Further, the edge guides 20 and 30 can strike the opposite side edges of the recording paper P a plurality of times until the difference falls within the predetermined allowable value. As a result, the opposite side edges of the recording paper P can be finally aligned in a sufficiently tidy manner.

The recording apparatus 1 according to the second other embodiment includes the paper stacking section 11 on which the recording paper P is stacked; the first edge guide 20 and the second edge guide 30 which is movable in the width direction X of the recording paper P and which align the side edges of the recording paper P stacked on the paper stacking section 11; the feeding motor 77 which moves the first edge guide 20 and the second edge guide 30; the controller 2 which determines whether the electric current value at the time when the feeding motor 77 is driven reaches the predetermined threshold value; and the position detecting section 5 which detects the position of the first edge guide 20 and the second edge guide 30 in the width direction X. Here, when the side edges of the recording paper P are aligned, the controller 2 moves the first edge guide 20 and the second edge guide 30 to be close to the recording paper P by the power of the feeding motor 77 while monitoring the electric current value (step S31), and determines whether the difference between the position (step S33) of the first edge guide 20 and the second edge guide 30 at the time when the electric current value reaches the predetermined threshold value (step S32) and the position of the first edge guide 20 and the second edge guide 30 corresponding to the size of the recording paper P which is input to the recording apparatus 1 and is recognized by the recording apparatus 1 on the basis of the recording information is equal to or smaller than the predetermined allowable value (step S34). In the case where it is determined that the difference is not equal to or smaller than the predetermined allowable value, the controller 2 moves the first edge guide 20 and the second edge guide 30 to be spaced from the recording paper P by the power of the feeding motor 77 (step S35), and then, moves the first edge guide 20 and the second edge guide 30 to be close to the recording paper P until the electric current value reaches the predetermined threshold value while monitoring the electric current value (step S31).

In the above described embodiment, the hopper moves close to or away from the feeding roller, but the feeding roller may move close to or away from the hopper (or the paper stacking section). Alternatively, the paper stacking section may move close to or away from the feeding roller. In these cases, the same effect can be achieved.

In addition, the invention is not limited to the above embodiments, and a variety of modifications may be made in the scope of the appended claims, which are included in the scope of the invention.

What is claimed is:

1. A recording apparatus comprising:

a stacking section on which a recording target medium is stacked;

edge guides which move in a width direction of the recording target medium and align side edges of the recording target medium which is stacked on the stacking section;

a motor which moves the edge guides;

a determining section which determines whether an electric current value at the time when the motor is driven reaches a predetermined threshold value; and a position detecting section which detects a position of the edge guides in the width direction, wherein when the side edges of the recording target medium are aligned, the edge guides move close to the recording target medium by means of power of the motor while the electric current value is being monitored by the determining section, and it is determined whether a difference between a position of the edge guides at the time when the electric current value reaches the predetermined threshold value and a position of the edge guides corresponding to the size of the recording target medium which is recognized on the basis of recording information by the recording apparatus is equal to or smaller than a predetermined allowable value, and wherein if it is determined that the difference is not equal to or smaller than the predetermined allowable value, the edge guides move away from the recording target medium by means of the power of the motor, and then, the edge guides move close to the recording target medium until the electric current value reaches the predetermined threshold value while the electric current value is being monitored.

2. A recording apparatus comprising:

a stacking section on which a recording target medium is stacked;

edge guides which move in a width direction of the recording target medium and align side edges of the recording target medium which is stacked on the stacking section;

a motor which moves the edge guides;

a determining section which determines whether an electric current value at the time when the motor is driven reaches a predetermined threshold value; and a position detecting section which detects a position of the edge guides in the width direction, wherein when the side edges of the recording target medium are aligned, the edge guides move close to the recording target medium by means of power of the motor while the electric current value is being monitored by the determining section, and a position of the edge guides at the time when the electric current value reaches the predetermined threshold value is stored, wherein the edge guides move away from the recording target medium by means of the power of the motor, and then, the edge guides move close to the recording target medium while the electric current value is being monitored and it is determined whether a difference between a position of the edge guides at the time when the electric current value reaches the predetermined threshold value and the stored position of the edge guides is equal to or smaller than a predetermined allowable value, and wherein if it is determined that the difference is not equal to or smaller than the predetermined allowable value, the edge guides move away from the recording target medium by means of the power of the motor, and then, the edge guides move close to the recording target medium until the electric current value reaches the predetermined threshold value while the electric current value is being monitored.

3. The recording apparatus according to claim 1, wherein when the operation of aligning the side edges of the recording target medium is performed, the edge guides move close to the recording target medium in a movable range of the edge guides, wherein in a case where the electric current value reaches the predetermined threshold value in a position exceeding a position corresponding to the recording target medium having a minimum usable size, an operation of enabling the edge guides to come into contact with the side edges of the recording target medium is performed a plurality of times, and wherein in the case where the electric current value reaches the predetermined threshold value in the position exceeding the position corresponding to the recording target medium having the minimum usable size, the edge guides move away from the recording target medium and then stop.

4. The recording apparatus according to claim 1, further comprising:

a feeding unit which feeds the recording target medium to a recording section which is installed on a downstream side from the stacking section in a feeding direction; and a sensor which measures the amount of the recording target medium fed by the feeding unit, wherein the motor serves as a motor which drives the feeding unit, and wherein the position detecting section performs detection using the sensor.

* * * * *